US009165735B2

(12) United States Patent
Sanders, III et al.

(10) Patent No.: US 9,165,735 B2
(45) Date of Patent: Oct. 20, 2015

(54) HIGH RELIABILITY, HIGH VOLTAGE SWITCH

(75) Inventors: James J. Sanders, III, Belmont, MA (US); Eric P. Bergeron, Melrose, MA (US)

(73) Assignee: Teradyne, Inc., North Reading, MA (US)

( * ) Notice: Subject to any disclaimer, the term of this patent is extended or adjusted under 35 U.S.C. 154(b) by 783 days.

(21) Appl. No.: 13/412,125

(22) Filed: Mar. 5, 2012

(65) Prior Publication Data

US 2013/0229068 A1 Sep. 5, 2013

(51) Int. Cl.
*H01H 47/22* (2006.01)
*H01H 47/00* (2006.01)

(52) U.S. Cl.
CPC ..... *H01H 47/002* (2013.01); *Y10T 307/76* (2015.04)

(58) Field of Classification Search
CPC ..... H01H 47/002
USPC ..... 307/112, 113
See application file for complete search history.

(56) References Cited

U.S. PATENT DOCUMENTS

2004/0113713 A1* 6/2004 Zipper et al. ..... 333/103
2006/0072754 A1* 4/2006 Hinton et al. ..... 380/263
2006/0238936 A1 10/2006 Blanchard et al.
2008/0164961 A1 7/2008 Premerlani et al.
2010/0254062 A1 10/2010 Chan et al.

OTHER PUBLICATIONS

International Search Report from corresponding PCT Application No. PCT/US2013/026099, dated Sep. 18, 2014.
Jose Moreira et al., "Analyzing and Addressing the Impact of Test Fixture Relays for Multi-Gigabit ATE I/O Characterization Applications", *IEEE International Test Conference*, Paper 8.2, pp. 1-10, 2007.

* cited by examiner

*Primary Examiner* — Jared Fureman
*Assistant Examiner* — Joel Barnett
(74) *Attorney, Agent, or Firm* — Wolf, Greenfield & Sacks, P.C.

(57) ABSTRACT

A high reliability, high voltage electronically controllable switch is created from a combination of relays of different types, with different characteristics, such as an electromechanical relay and an optoelectronic relay. The relays are closed and/or opened in accordance with a sequence that avoids actuating an electromechanical relay of such a compound switch to close or open under conditions that degrade the operating life of the electromechanical relay, even if the compound switch is hot switched under high voltage conditions. The switching sequence ends with the relays in a state that provides low on resistance, low crosstalk, low capacitance and/or low leakage. The switch can be relatively compact, enabling construction of an instrument serving as a switch matrix for an automatic test system.

23 Claims, 13 Drawing Sheets

| turn ON | time | -0.1 | 0 | 0.15 | 0.65 | 5.65 | 6.15 | ready |
|---|---|---|---|---|---|---|---|---|
| | U1 | OFF | ON | ON | ON | ON | ON | |
| | K2 | OFF | OFF | ON | ON | ON | ON | |
| | U3 | OFF | OFF | OFF | ON | ON | ON | |
| | K4 | OFF | OFF | OFF | OFF | ON | ON | |

750

| turn OFF | time | -0.1 | 0 | 0.5 | 1 | 1.5 | 1.6 | ready |
|---|---|---|---|---|---|---|---|---|
| | U1 | ON | ON | ON | ON | OFF | OFF | |
| | K2 | ON | ON | ON | OFF | OFF | OFF | |
| | U3 | ON | ON | OFF | OFF | OFF | OFF | |
| | K4 | ON | OFF | OFF | OFF | OFF | OFF | |

760

| | time | -0.1 | 0 | 0.5 | 0.65 | 1.15 | 6.15 | 6.65 |
|---|---|---|---|---|---|---|---|---|
| turn ON | K1 | OFF | **ON** | ON | ON | ON | ON | ON |
| | U2 | OFF | OFF | **ON** | ON | ON | ON | ON |
| | K3 | OFF | OFF | OFF | **ON** | ON | ON | ON |
| | U4 | OFF | OFF | OFF | OFF | **ON** | ON | ON |
| | K5 | OFF | OFF | OFF | OFF | OFF | **ON** | ON |
| | ready | | | | | | | |

850

| | time | -0.1 | 0 | 0.5 | 1 | 1.5 | 1.6 | 2.1 |
|---|---|---|---|---|---|---|---|---|
| turn OFF | K1 | ON | ON | ON | ON | ON | **OFF** | OFF |
| | U2 | ON | ON | ON | ON | **OFF** | OFF | OFF |
| | K3 | ON | ON | ON | **OFF** | OFF | OFF | OFF |
| | U4 | ON | ON | **OFF** | OFF | OFF | OFF | OFF |
| | K5 | ON | **OFF** | OFF | OFF | OFF | OFF | OFF |
| | ready | | | | | | | |

860

950

| turn ON | | | | | | | | | | | | |
|---|---|---|---|---|---|---|---|---|---|---|---|---|
| time | -0.1 | 0 | 0.5 | 0.65 | 1.15 | 6.15 | ready | | | | | |
| K1 | OFF | ON | ON | ON | ON | ON | ON | | | | | |
| U2 | OFF | OFF | ON | ON | ON | ON | ON | | | | | |
| K3 | OFF | OFF | OFF | ON | ON | ON | ON | | | | | |
| U4 | OFF | OFF | OFF | OFF | ON | ON | ON | | | | | |
| K5 | OFF | OFF | OFF | OFF | OFF | ON | ON | | | | | |

960

| turn OFF | | | | | | | | | | | | |
|---|---|---|---|---|---|---|---|---|---|---|---|---|
| time | -0.1 | 0 | 0.5 | 1 | 1.5 | 1.6 | ready | | | | | |
| K1 | ON | ON | ON | ON | ON | OFF | OFF | | | | | |
| U2 | ON | ON | ON | ON | OFF | OFF | OFF | | | | | |
| K3 | ON | ON | ON | OFF | OFF | OFF | OFF | | | | | |
| U4 | ON | ON | OFF | OFF | OFF | OFF | OFF | | | | | |
| K5 | ON | OFF | OFF | OFF | OFF | OFF | OFF | | | | | |

| | time | -0.1 | 0 | 0.5 | 0.65 | 1.15 | 1.5 | 6.15 | 6.65 | ready |
|---|---|---|---|---|---|---|---|---|---|---|
| turn ON | K1 | OFF | ON | ON | ON | ON | ON | ON | ON | |
| | U2 | OFF | OFF | ON | ON | ON | ON | ON | ON | |
| | K3 | OFF | OFF | OFF | ON | ON | ON | ON | ON | |
| | U4 | OFF | OFF | OFF | OFF | ON | ON | ON | ON | |
| | K5 | OFF | OFF | OFF | OFF | OFF | OFF | ON | ON | |

1050

| | time | -0.1 | 0 | 0.5 | 1 | 1.5 | 1.6 | 2.1 | ready |
|---|---|---|---|---|---|---|---|---|---|
| turn OFF | K1 | ON | ON | ON | ON | ON | OFF | OFF | |
| | U2 | ON | ON | ON | ON | OFF | OFF | OFF | |
| | K3 | ON | ON | ON | OFF | OFF | OFF | OFF | |
| | U4 | ON | ON | OFF | OFF | OFF | OFF | OFF | |
| | K5 | ON | OFF | OFF | OFF | OFF | OFF | OFF | |

1060

HIGH RELIABILITY, HIGH VOLTAGE SWITCH

BACKGROUND

Electronic components, such as semiconductor devices, are frequently tested, sometimes multiple times during their manufacture, using automatic test equipment. To perform these tests, automated test equipment may include instruments that generate or measure test signals such that a range of operating conditions can be tested on a particular device. An instrument may generate or measure a pattern of digital signals to enable testing of digital logic within a semiconductor device. Other instruments may generate high frequency analog signals, while others might generate waveforms of arbitrary shapes. Some instruments may also generate or measure relatively high voltages, either for testing high voltage portions of a device or for supplying power to a device under test.

To support testing of multiple types of devices, or to support running multiple tests on the same type of device, automatic test system may be configurable so that different instruments may be coupled to different test points at different times. A test system may include a switch matrix that allows any of a number of instruments to be switched to any of a number of test points.

For low voltage signals, whether analog or digital, the switch matrix may be implemented with reed relays. Reed relays are electromechanical relays, which provide a low on resistance and a low leakage current when off. For higher voltages, electromechanical relays may also be used. However, switching of higher voltage signals can create reliability problems in electromechanical relays that do not occur with lower voltage signals. As one example, electromechanical relays switching high voltages may "stick," such that they do not open reliably after some period of operation.

The contact resistance of electromechanical relays used for switching high voltages may also vary unpredictably. A variation in contact resistance can be particularly problematic for a test system because a change of even one Ohm in contact resistance can change test results. For example, a relay might be designed for a nominal contact resistance on the order of 50 milliOhms. A change of one Ohm would be significant as a percentage of the expected on resistance. In an automatic test system, a relay might be switched into a different configuration multiple times during the test of a single device, and might test thousands of devices in a day. As a result, if a relay fails after switching even tens of thousands of times, the relay will fail after a very short period of use.

In the past, mercury wettable switches were sometimes used to reduce reliability concerns for higher voltage signals. These switches contained mercury, which could be used to quickly and reliably close the relay without arcing. Mercury wetted switches have significantly longer lives than dry-switched relays. Though, mercury switches recently have become disfavored because they are not suited for modern test systems that are designed to allow a test head to be placed in multiple orientations. Because a mercury switch is position sensitive, if the test head is moved to a position in which the switch does not operate, the test system might not perform as expected. In addition, mercury switches may be prohibited in some locations because of environmental concerns.

Accordingly, some test systems use "dry" electromechanical relays even for high voltage signals. Owners of such test systems may be advised not to reconfigure the test system so as to cause a relay to switch while a high voltage is across it.

Such switching, sometimes called "hot switching," can contribute to the failure of relays after a relatively low number of cycles.

Hot switching can be useful in automatic test systems and other applications. For testing semiconductor devices, throughput of the test system is a significant contributor to efficiency in a manufacturing facility. Hot switching allows the test system to quickly move from stage to stage in a test job, improving throughput. To address reliability concerns with hot switching, some users of automatic test instruments have built test system interface boards that include relatively large relays that are less susceptible damage if hot switched. In addition, these relays may be mounted in sockets such that, if a failure occurs, the relay can be easily replaced.

Alternatives to using electromechanical switches include using solid state relays, such as optoelectronic relays. However, solid state relays have a higher on resistance than reed relays. For some applications, including automatic test systems, a high on resistance is undesirable. In addition, solid state switches can generate crosstalk, which can interfere with testing operations.

A further alternative for avoiding the need for hot switching is to configure the test system to avoid the need for switching high voltage instruments. A sufficient number of high voltage instruments could be provided such that each test point to receive a high voltage signal could have a dedicated connection to an instrument. Though, this approach can be expensive.

SUMMARY

Reliable switching of high voltages is provided through a compound switch that includes both an electromechanical and a solid state switching device. To open or close the compound switch, the individual switching devices are controlled in accordance with a sequence that avoids actuating the electromechanical switching device while there is a potentially damaging voltage across terminals of the electromechanical switching device. The order in which the constituent switching devices of the compound switch are actuated may depend on whether the compound switch is being opened or closed, allowing the electromechanical switching device to be isolated from potentially damaging voltages during both opening and closing sequences.

In some embodiments, a solid state switching device and an electromechanical switching device may be configured and controlled as a compound switch such that, during a closing cycle, the electromechanical switching device closes while the solid state switch is in a high resistance state. These components may be connected such that they form a voltage divider between the terminals of the compound switch. As a result, any voltage across the terminals of the compound switch is distributed across the higher resistance of the solid state switch, isolating the electromechanical switching device from the high voltage. During an opening sequence, the switching sequence may be reversed such that the electromechanical switching device is also actuated while isolated from a voltage above a threshold by the solid state switching device.

In some embodiments, a solid state switching device and an electromechanical switching device may be configured and controlled as a compound switch such that, during a closing cycle, the electromechanical switching device closes while the solid state switching device is closed, completing a connection across terminals of the electromechanical switching device that provides a low voltage drop.

In some embodiments, one or more electromechanical switching devices may be used in combination with two or more solid state switching devices. These solid state switching devices may have different electrical performance parameters. One solid state switching device may have a low on resistance for completing a connection across terminals of the electromechanical switching device. Another solid state switching device isolating an electromechanical switching device may have a low off capacitance. The solid state switching device with a low off capacitance may isolate the electromechanical switching device from a voltage above a threshold associated with a reduction in reliability, even if the hot switched voltage across the compound switch is an AC voltage or includes a transient component.

Various configurations of the switching devices may be used to form a compound switch. For low leakage in the open state, the electromechanical switching device may be connected in series with the solid state switching device. For a low on resistance for the compound switch, the electromechanical switching device may be connected in parallel with the solid state switching device. For both a low on resistance and low leakage, the compound switch may include multiple electromechanical switching devices, providing paths in series with and shunting the solid state switching element.

In some embodiments, multiple solid state switching devices may be used in the compound switch. The solid state switching devices may have different characteristics and may be controlled in a sequence such that different solid state switching devices are actuated at different times. In some specific embodiments, at least two solid state switching devices may be employed in a compound switch. One device may have a lower capacitance, but higher resistance. The other may have a lower resistance, but higher capacitance. These components may be configured and operated such that, regardless of whether a resistive or capacitive voltage divider is created by the solid state switching devices at any time during actuation of the compound switch, the voltage across any electromechanical switching device is relatively low while the electromechanical switching device is opening or closing.

In some embodiments, the electromechanical switching device may be a reed relay. Such a component may provide a low on resistance and high isolation and may be free of mercury. Such a component may also provide low crosstalk. The compound switch may be configured such that, in a closed state and/or an open state, the properties of one or more electromechanical switching devices, such as reed relays, dominate the properties of the compound switch. Though, by engaging the solid state switching elements during actuation of the compound switch to isolate the electromechanical switching devices from the full voltage across the terminals of the compound switch, sensitive electromechanical switching devices, such as reed relays, are protected from damage. In this way, desirable switching properties can be obtained, even for hot switching scenarios.

In accordance with some embodiments, a compound switch provides good isolation, low leakage, low cross talk and low capacitance. Such a switch device is well suited for use in an automatic test system. A cross point switch comprising a plurality of such compound switches may be configured as an instrument for insertion into an automatic test system.

Accordingly, in some aspects, the invention may be embodied in a compound switch.

In a further aspect, the invention may be embodied in an instrument for an automatic test system using multiple compound switches.

In yet a further aspect, the invention may be embodied in a method of operating a compound switch.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

The inventors have recognized and appreciated that the reliability of an automatic test system may be improved through the use of a compound switch formed by operating multiple switching devices of different characteristics controlled in accordance with a sequence. One or more of the switching devices may be electromechanical relays, such as reed relays or micro-electromechanical machined (MEM) devices. Though these switching devices may be of a type that is susceptible to damage when hot switching high voltages, the configuration of the switching devices and operating sequence may be such that the electromechanical switching devices are isolated from high voltages during switching.

Such compound switches may be used in other settings where it is desirable to perform hot switching of voltages above a threshold associated degradation of reliability. For example, in power control devices, such as those associated with the "smart grid," such compound switches may also be useful. Accordingly, though compound switches are described herein in connection with their use in automatic test systems, it should be appreciated that that environment is exemplary rather than limiting of the inventive concepts disclosed.

Figure 1A:
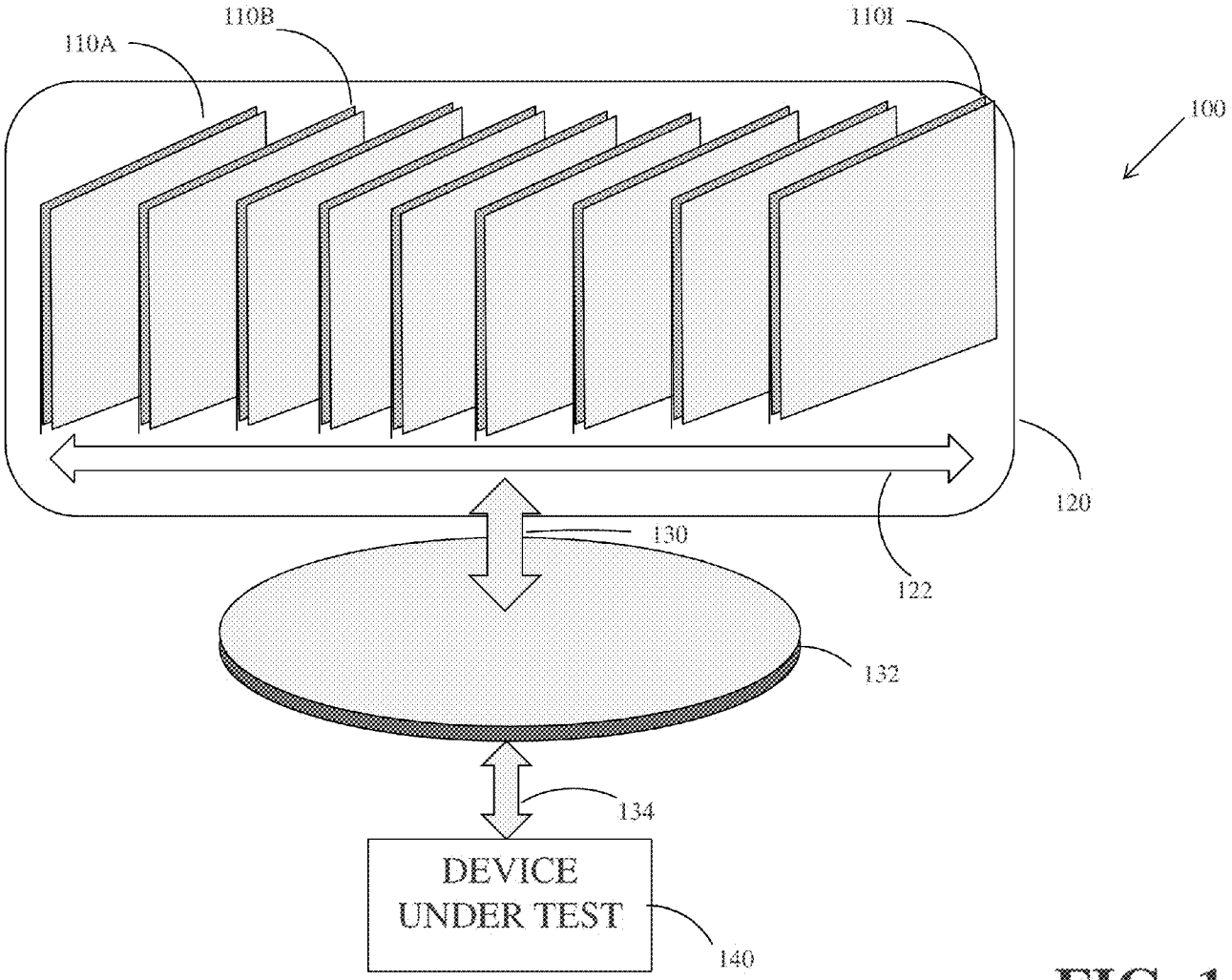
FIG. 1A is a schematic illustration of an exemplary embodiment of a test system.

FIG. 1A is a schematic illustration of an automatic test system for testing semiconductor devices in which compound switches as described herein may be used. Test system 100 may be constructed using techniques as are known in the art. Though, in the illustrated embodiment, test system 100 is constructed using compound switches in place of reed relays.

FIG. 1A illustrates that test system 100 includes a test head 120. As in a conventional test system, test head 120 includes multiple instrument boards 110A, 110B . . . 110I. Each of the instrument boards contains electronic circuitry to generate and/or measure a test signal applied to a device under test 140.

In operation, electrical signals are coupled between the instrument boards 110A, 110B . . . 110I and device under test 140 through a signal delivery interface.

In the embodiment illustrated in FIG. 1A, the signal delivery interface includes signal paths 122 within test head 120. Signal paths 122 may be created in any suitable way, including as traces on a backplane, using cabling or using any other suitable interconnection technology.

In the embodiment illustrated, the signal delivery interface includes a device interface board 132. Device interface board 132 may be constructed using techniques as are known in the art to route signals between a coupling 130, designed to align with signal paths 122 within test head 120 and coupling 134, designed to align with a device under test 140. Coupling 130 may be implemented in any suitable way. For example, coupling 130 may be implemented as one or more electrical connectors or interposers.

Coupling 134 similarly may be implemented in any suitable way. Though, the specific implementation of coupling 134 may depend both on the nature of the device under test 140 and its state of manufacture at which it is tested. For example, for testing a packaged semiconductor device, coupling 134 may be a socket adapted to receive the packaged semiconductor device. Alternatively, device under test 140 may be tested while still on a semiconductor wafer. In that scenario, coupling 134 may be implemented using conductive probes designed to make contact with pads on the surface of a semiconductor wafer. Accordingly, it should be appreciated that the specific implementation of coupling 130 and coupling 134 are not critical to the invention.

As in a conventional test system, device interface board 132 may be configured for a specific device under test. In addition to routing signals between the test head and the test points on the device under test, device interface board 132 may contain electronic components that perform signal routing or processing functions that are not supported by the instruments 110A, 110B . . . 110I within test head 120.

Being able to generate and measure different types of test signals at different locations on different types of devices under test may entail rearranging the connections between the instruments boards 110A, 110B . . . 110I and device under test 140 at different times during operation of test system 100. In fact, FIG. 1A provides a simplified illustration of a test system configuration. FIG. 1A illustrates the test system 100 testing a single device under test 140. In many embodiments, a test system may test multiple devices under test concurrently. Moreover, each device under test may contain multiple functional regions that, because of limitations on the number and types of test signals that can be generated or measured by the circuitry on instrument boards 110A, 110B . . . 110I, cannot be tested concurrently. Rather, during execution of a test job in which all of the functional regions are tested, multiple separate tests may be executed. Execution of the tests may entail reconfiguring connections between the instrument boards 110A, 110B . . . 110I and device under test 140.

To facilitate reconfiguring these connections, test system 100 may include multiple switching devices. To facilitate rearranging connections between circuitry on the instruments boards 110A, 110B . . . 110I and test points on a device under test 140, one or more switching devices may be included on device interface board 132, as is known in the art. These switching devices may be controlled by a program executing on a test system computer (not shown) or in any other suitable way. The switching devices may be opened or closed to connect specific ones of the instrument boards to specific locations on the device under test 140.

Adding functionality on a device interface board may, in some scenarios, provide useful flexibility. However, in other scenarios it is desired to configure a test system 100 for testing many different types of devices using the functionality contained on the instrument boards 110A, 110B . . . 110I that are otherwise installed in the test system without using additional components on device interface board 132. Accordingly, in some embodiments, it may be desirable to include switching devices in a generalized configuration within test head 120. In this way, the test system 100 may be readily configured for testing a specific device under test without requiring the complexity or added cost of including the switching devices on a device interface board 132. One example of a technique for incorporating switching devices within test head 120 is provided by FIG. 1B.

Figure 1B:
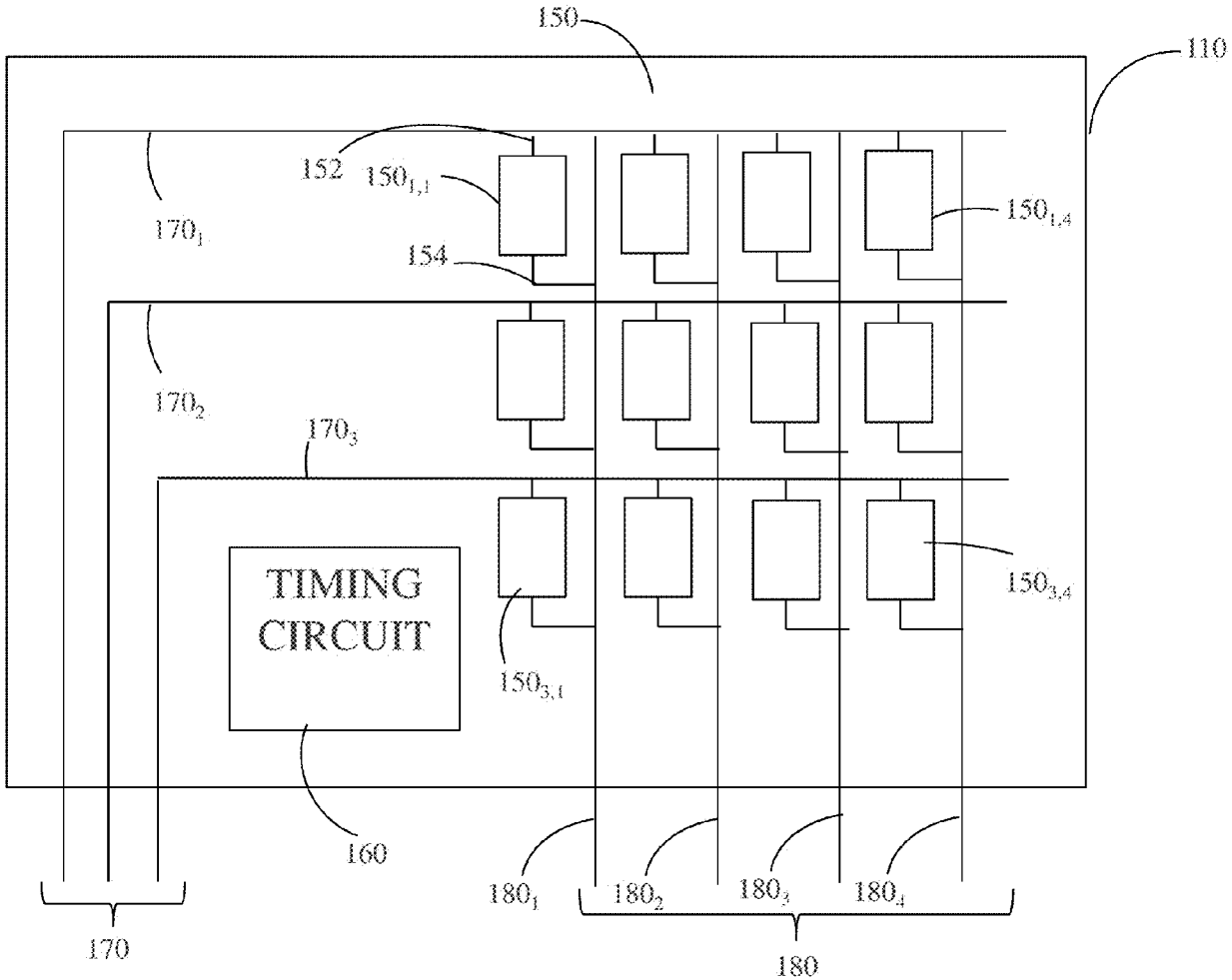
FIG. 1B is a schematic illustration of an exemplary embodiment of instrument implementing a switch matrix.

FIG. 1B illustrates an instrument board 110, which may be installed within test head 120 such that it could be connected to signal paths 122. In the example of FIG. 1B, instrument board 110 includes inputs 170 and outputs 180. When used in a test system, such as test system 100 (FIG. 1A), inputs 170 may be connected to some of the signal paths 122 that run to one or more of the instruments 110A, 110B . . . 110I. Outputs 180 may be connected to others of the signal paths 122 routing signals through coupling 130 to device under test 140. Within instrument 110 a switch matrix 150 may be configured to connect any one of the inputs 170 to any one of the outputs 180.

In the specific example illustrated in FIG. 1B, there are three input lines 170, designated input line $\mathbf{170}_1$, $\mathbf{170}_2$ and $\mathbf{170}_3$. There are four output lines 180, designated output line $\mathbf{180}_1$, output line $\mathbf{180}_2$, output line $\mathbf{180}_3$ and output line $\mathbf{180}_4$. Switching devices within switch matrix 150 may be controlled to connect any one of the input lines 170 to any one of the output lines 180. In this example, to provide that functionality, switch matrix 150 includes twelve switching devices. Each of the switching devices connects one of the input lines 170 to one of the output lines 180. For example, as shown, switching device $\mathbf{150}_{1,1}$ has a terminal 152 connected to input line $170_1$. Switching device $150_{1,1}$ also has a terminal 154 connected to output line $180_1$ such that switching device $150_{1,1}$ can connect input line $170_1$ to output line $180_1$. Similarly, switching device $150_{1,4}$ is shown connecting input line $170_1$ to output line $180_4$. Switching device $150_{3,1}$ is shown connecting input line $170_3$ to output line $180_1$. Switching device $150_{3,4}$ is shown connecting input line $170_3$ to output line $180_4$. Other switching devices within matrix 150 are shown but not numbered for simplicity.

In operation, an input line may be connected to an output line by activating the switching device associated with those two lines. For example, to connect input line $170_1$ to output line $180_1$, switching device $150_{1,1}$ may be placed in a low resistance state. Conversely, to disconnect input line $170_1$ from output line $180_1$, switching device $150_{1,1}$ may be placed in a high resistance. The low resistance state may sometimes be referred to as an "on" or "closed" state and the high resistance state may sometimes be referred to as an "off" or "open" state.

In operation of a test system, it is frequently desirable for connections that form a signal path, such as is formed through switching device $150_{14}$ to be low resistance. In addition, in some embodiments, providing a switching device that can be "hot switched" may also be desirable. Hot switching entails opening or closing the switching device while operational voltages are present across its terminals, such as terminal 152 or 154. Such a scenario may arise, for example, when reconfiguring a test system during execution of a test job. Depending on the nature of the device being tested and the nature of the instrument generating or measuring signals used during a test, the voltage across terminals of any of the switching device, such as terminals 152 and 154 may be on the order of a few volts to tens of volts. Voltages at these levels may cause reliability problems for conventional switching devices. Such problems may include reduced operational life or reduced reliability.

Using larger components that are less susceptible to reliability problems associated with hot switching may not be possible in a configuration as illustrated in FIG. 1B, because large switching devices physically may not fit in the space available on instrument board 110. In this regard, it should be appreciated that FIG. 1B is a simplified illustration of a switch matrix instrument. In a test system, there may be more input and output lines than illustrated in FIG. 1B. For example, in some embodiments, a switch matrix instrument may have 24 input lines and 8 output lines, requiring 96 separate switching devices to implement a switch matrix. In that scenario, large switching devices may preclude the use of an instrument internal to the test system. Though, using smaller but less reliable components may preclude the use of an instrument internal to a test head 120. Less reliable components for example may be mounted on the device interface board 132 using mounting techniques that provide ready access to the switching devices such that, if failures occur, the switching devices may be readily replaced.

In accordance with some embodiments of the invention, switching devices that are small enough and reliable enough to be incorporated on a switch matrix instrument board are implemented as compound switches. Compound switches may be assembled from electromechanical and solid state switching devices of any suitable type. In some embodiments, combinations of three different types of switching devices may be used to construct a compound switch (also referred to as comboswitch).

Figure 2A:
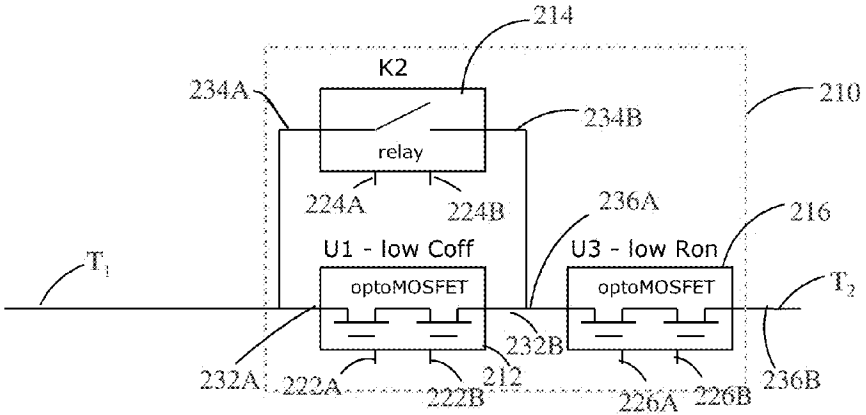
FIG. 2A is a schematic illustration of a first exemplary embodiment of a compound switch.
Figure 3A:
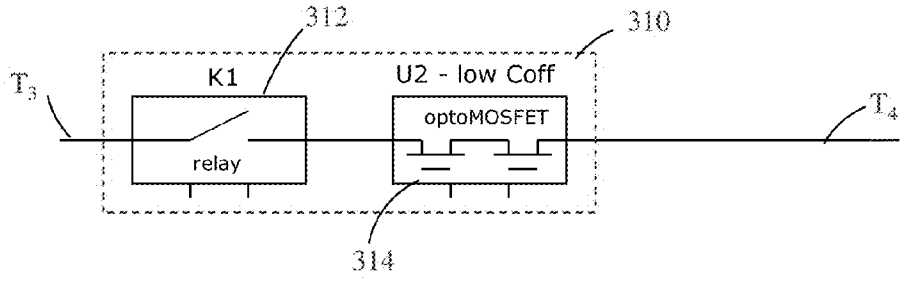
FIG. 3A is a schematic illustration of a second exemplary embodiment of a compound switch.

In the illustrative embodiments of FIGS. 2A, 3A . . . 12A, the switching devices used to form compound switches include an electromechanical switch and two types of solid state switching devices. The electromechanical switching device may be a reed relay as is known in the art. The solid state switching devices may be implemented as optoMOSFETs (MOSFET switch controlled by light generated by an LED). The two optoMOSFETs may have different parameters. Accordingly, the components of a compound switch may be:

1. Electromechanical switch;
2. optoMOSFET, low Coff;
3. optoMOSFET, low Ron.

Compound switches may be constructed from combinations of zero or more elements of each type. Though, it should be appreciated that in other embodiments, different or additional elements may be used in constructing compound switches. The switching devices used to form a compound switch may be switching devices as are known in the art. These switching devices, and the compound switch as a whole, may be characterized by one or more parameters. Table 1 lists representative parameters that may characterize switching devices.

TABLE 1

| Parameter | Unit | Description |
|---|---|---|
| Roff | Ohm | resistance across switch "contacts" in OFF state |
| Coff | pF | capacitance across switch "contacts" in OFF state |
| Ron | Ohm | resistance across switch "contacts" in ON state |
| Ton | msec | time to change from OFF state to ON state |
| Toff | msec | time to change from ON state to OFF state |
| Ton + Toff | msec | |
| Idc | Ampere | current rating of ON switch |
| Vsw | Volt | voltage allowed across switch at time of OFF to ON |
| Isw | Ampere | current allowed through switch as it turns ON |
| FOM2 | | 100/(Ron * Coff) is a Figure of Merit, higher value is better, related to a commonly used figure of merit Ron * Coff. |
| FOM4 | | Roff * Isw * Vsw/(Ron * Coff * (Ton + Toff)) is a Figure of Merit, higher value is better |

Switching devices with any suitable values of these parameters may be used in forming a compound switch. However, in some embodiments, the commonly used value parameter for a switch, Ron*Coff, is more than 100 times lower for the electromechanical switching device than for any solid state switching device used in the compound switch.

The Vsw level for the electromechanical switching device, for switching to moderate values of capacitive load (on the order of 1 nF), may be very low e.g. less than 1 Volt. Such values of Vsw may significantly extend operating lifetime of the electromechanical switching device. Vsw may be set as a threshold associated with degradation in reliability. The value of Vsw, for example, may be determined from accelerated life-cycle testing by identifying a value of a hot switched voltage that leads to a probability of degradation in reliability after some number of switching cycles. For an automatic test system, the hot switched voltage may be on the order of 1 Volt and the number of switching cycles, for example, may be on the order of hundreds of thousands. Though, it should be appreciated that other values of these parameters may be used in determining Vsw. An acceptable degradation in reliability may be—as just one example—a 5% increase in likelihood of failure over the rated lifetime of the switching device such that Vsw is selected as the hot switched voltage that provides this level of reliability. Regardless of how obtained, the value of Vsw may be used in selecting a compound switch architecture or selecting specific components for a compound switch for a particular application. For a compound switch, the switching device with the lowest rated voltage determines the maximum Vsw for the compound switch.

Values of other parameters may be used in selecting a compound switch architecture and/or components for implementing a compound switch. As another example, Coff of the low Coff optoMOSFET may be low enough that the electromechanical switching device can switch the desired voltage difference Vsw into the optoMOSFET.

Ron of the low Ron optoMOSFET may be comparable to the Ron of the electromechanical switching device, within a factor of 3.

In some embodiments, useful, for example in connection with test equipment carrying voltages on the order of tens of volts or less and currents on the order of tens of Amps or less, an electromechanical switching device used in a compound switch may have characteristics, such as:

| | | |
|---|---|---|
| Roff | 1.0E+12 | ohm |
| Coff | 0.2 | pF |
| Ron | 0.15 | ohm |
| Ton + Toff | 1.0 | msec |
| Idc | 1.0 | Amp |
| Vsw | 0.1 | Volt |
| Isw | 1.0 | Amp |
| FOM2 | 3333 | |
| FOM4 | 3.3E+12 | |

Such characteristics may be achieved in any suitable switching device. However, in the embodiments described herein for an automatic test system, these parameters may be achieved in a reed relay, as in known in the art.

Compound switches may incorporate solid state switching devices of any suitable type. In some embodiments, different solid state switching devices may be used, possibly in combination. Solid state switching devices may be selected to provide, for example, a low off capacitance or a low on resistance. Typically, these parameters are mutually exclusive. An example of parameters of a solid state switching device with a low off capacitance are:

| | | |
|---|---|---|
| Roff | 2.0E+11 | ohm |
| Coff | 10.0 | pF |
| Ron | 50 | ohm |
| Ton + Toff | 0.25 | msec |
| Idc | 0.04 | Amp |
| Vsw | 200 | Volt |
| Isw | 0.04 | Amp |
| FOM2 | 0.2 | |
| FOM4 | 1.3E+10 | |

An example of parameters of a solid state switching device with a low on resistance are:

| | | |
|---|---|---|
| Roff | 6.0E+09 | ohm |
| Coff | 600 | pF |
| Ron | 0.12 | ohm |
| Ton + Toff | 5.5 | msec |
| Idc | 2.0 | Amp |
| Vsw | 60 | Volt |
| Isw | 2.0 | Amp |
| FOM2 | 1.4 | |
| FOM4 | 1.8E+09 | |

These parameters may be achieved in a solid state switching device manufactured using techniques as are known in the art. In embodiments in which two or more solid state switching devices are used as part of a compound switching device, the solid state switching devices may be constructed and packaged separately. Though, in other embodiments, the solid state switching devices used in a single compound switch or in multiple compound switches used together on an instrument board may be implemented on a common substrate and/or packaged in a common housing. Accordingly, it should be appreciated that any suitable techniques may be used to implement the elements forming a compound switch. Moreover, it should be appreciated that the specific values for the parameters provided above are illustrative rather than limiting.

In the example of FIG. 1B, switching devices $\mathbf{150}_{1,1}$ . . . $\mathbf{150}_{3,4}$ in the switch matrix 150 are compound switches, each of which is made up of multiple switching devices. To open or close the compound switch, the constituent switching devices are opened or closed. In some embodiments, the order in which each of the switching devices forming a compound switch are actuated, when the compound switch either opens or closes, may impact the reliability of the compound switch. In the illustrated embodiments, the switching devices forming a compound switch are actuated, either upon opening or closing of the compound switch, in an order that allows any electromechanical switching devices that are part of the compound switch to be actuated at a time when a relatively "low" voltage is across terminals of the electromechanical switching device.

In this context, a "low" voltage may be determined as a voltage that is less than the Vsw for the switching device. This Vsw may be measured as a DC voltage or as an AC voltage or transient that is present during switching. Though, the specific voltage level that is deemed low for any specific embodiment may depend on any suitable number of parameters, including the system in which the switching device is used. The value, for example, may be based on a threshold below which switching does not significantly impact the reliability of the electromechanical switching device. For example, for an electromechanical switching device implemented as a reed relay, that threshold may be on the order of one volt. Accordingly, in a compound switch implemented using such a reed relay, other components may be configured and operated such that, when the reed relay is activated, either opening or closing the reed relay, less than about one volt is across the terminals of the reed relay.

Because the constituent switching devices in a compound switch may be exposed to different voltages at different times, the timing with which each of the constituent switching devices are actuated may impact the overall reliability of the compound switch. Accordingly, FIG. 1B shows that instrument 110 includes a timing circuit 160. Though control inputs are not expressly illustrated in FIG. 1B, timing circuit 160 may receive control inputs indicating that one or more of the compound switches in switch matrix 150 is to open or close. In response, timing circuit 160 may generate the control signals in a prescribed order for the constituent switching devices within the compound switch. This order may be programmed in time circuit 160 to ensure that, when the electromechanical switching devices within the compound switch are actuated, the voltage across the terminals of the electromechanical switching device is below the threshold.

Figure 2B:
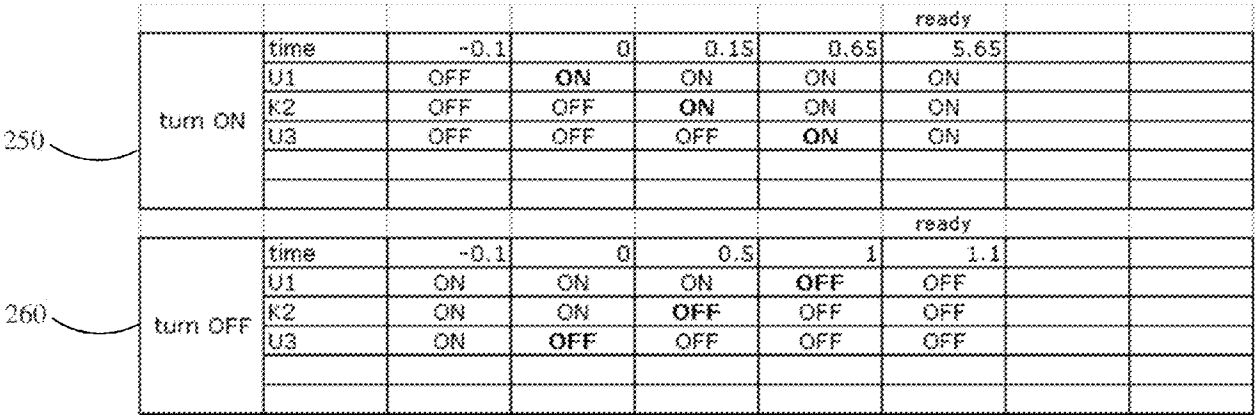
FIG. 2B is a table illustrating a sequence of operations in actuation of the compound switch of FIG. 2A.
Figure 3B:
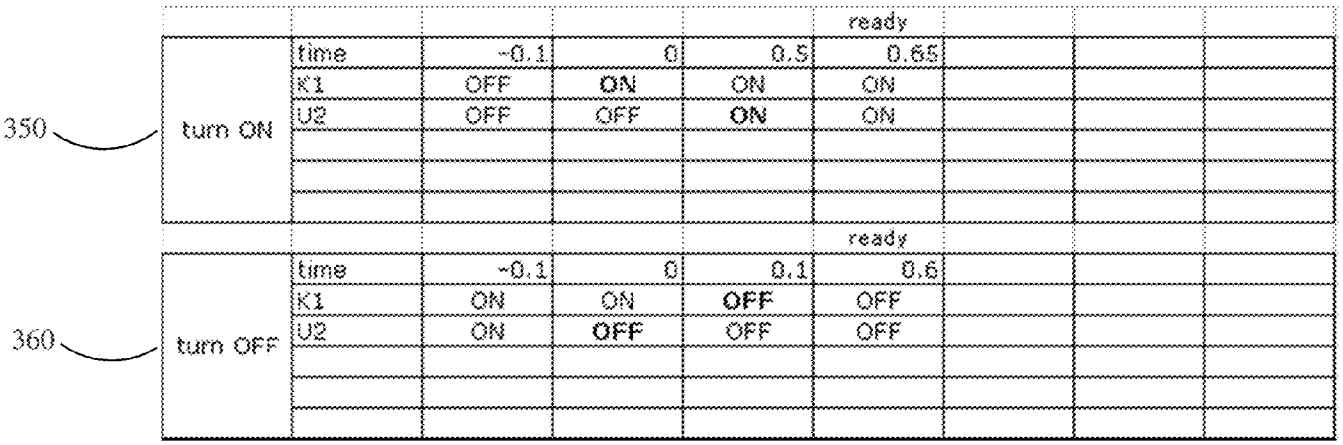
FIG. 3B is a table illustrating a sequence of operations in actuation of the compound switch of FIG. 3A.

FIGS. 2A, 3A . . . 12A illustrate various exemplary configurations of switching devices forming compound switches. FIGS. 2B, 3B . . . 12B illustrate switching sequences for opening and closing the compound switch. In these examples, the switching devices that are assembled into a compound switch are of the three types described above. For ease of understanding the drawings, each of the switching devices is identified with a letter and a number. Switching devices identified by the letter "K" are, in the illustrated embodiments, electromechanical switching devices. Switching devices identified by the letter "U" are, in the illustrated embodiments, solid state switching devices. The solid state switching devices are, in these examples optoMOSFETs and may be either of the low Coff or low Ron type, as described above.

The numbers associated with the designation of each of the switching devices illustrate a sequence of actuation as part of closing the compound switch. A switching device designated with a number "1" is closed before a switching device designated with the number "2." Likewise, a switching device designated with a number "2" is closed before a switching device designated with the number "3." For opening the compound switch, the switching devices are actuated in the reverse order of their numerical designation.

FIG. 2A illustrates a compound switch assembled with an electromechanical switching device K2 as well as two solid state switching devices U1 and U3, with different characteristics. The architecture of FIG. 2A may represent an architecture of a compound switch, per se, or may be a subpart of the architecture of another compound switch.

FIG. 2A illustrates a compound switch 210. The compound switch 210 includes terminals $T_1$ and $T_2$ and compound switch 210 may be "hot switched" with a voltage across these terminals. In this example, electromechanical switching device 214 is connected in parallel with solid state switching device 212. As can be seen, the switching devices that make up compound switch 210 have internal terminals that are either connected to the terminals of compound switch 210 or connect with other internal terminals. As shown, internal terminal 234A of electromechanical switching device 214 is connected to terminal 232A of solid state switching device 212. Likewise, internal terminal 234B of electromechanical switching device 214 is connected to internal terminal 232B of solid state switching device 212.

Solid state switching device 212 includes control terminals, here shown as control terminals 222A and 222B. When compound switch 210 is used in a circuit, such as switch matrix instrument 110 (FIG. 1B), control terminals 222A and 222B may be connected to a control circuit, such as timing circuit 160. A signal asserted across control terminals 222A and 222B may cause solid state switching device 212 to "close." Conversely, removing the control signal, or otherwise changing the state of the control signal applied across control terminals 222A and 222B, may cause solid state switching device 212 to change into an open state. Similarly, a signal asserted or de-asserted across control terminals 224A and 224B may cause electromechanical switching device 214 to close or open.

In the example illustrated in FIG. 2A, the parallel combination of solid state switching device 212 and electromechanical switching device 214 is connected in series with a solid state switching device 216. It can be seen that terminal 236A of solid state switching device 216 is connected to terminals 232B and 234B of solid state switching device 212 and electromechanical switching device 214, respectively. Solid state switching device 216 also has control terminals 226A and 226B.

In the example of FIG. 2A, solid state switching device 212 is identified as "U1." Accordingly, solid state switching device 212 is the first switching device constituting compound switch 210 that is switched as part of the closing sequence for compound switch 210. Electromechanical switching device 214 is designated as "K2." Accordingly, electromechanical switching device 214 is the second of the switching devices constituting compound switch 210 that is closed as part of the closing sequence of compound switch 210. Solid state switching device 216 is designated "U3." Accordingly, solid state switching device 216 is the third of the three switching devices constituting compound switch 210 that is closed as part of the closing sequence for compound switch 210.

This closing sequence allows electromechanical switching device 214 to close with a relatively low voltage across terminals 234A and 234B even if compound switch 210 is closed with a relatively high voltage across its terminals $T_1$ and $T_2$. The meaning of a relatively high voltage across terminals $T_1$ and $T_2$ may depend on the context in which compound switch 210 is operating. However, as one example, a relatively high voltage may be a voltage above a threshold at which an electromechanical switching device 214 may operate without significant degradation in reliability. Such a threshold may be determined by accelerated life cycle testing or using other techniques as are known in the art. In the context of an automatic test system for testing semiconductor devices, this threshold may be on the order of one volt. Though, in some embodiments, other parameters, such as the amount of current switched, may impact the specific voltage of the threshold.

Regardless of the specific value that defines the threshold, the configuration of compound switch 210 in combination with its operating sequence, allows electromechanical switching device 214 to switch with a voltage below this threshold across its terminals 234A and 234B. This operating condition is achieved by first, as part of the closing sequence for compound switch 210, closing solid state switching device 212. In this state, solid state switching device 216 is still in an off state. Accordingly, there is no DC path for current between terminals $T_1$ and $T_2$.

In this example, solid state switching device 212 has a low Coff and solid state switching device 216 has a low Ron. Though the on resistance of solid state switching device 212 may be higher that the on resistance of solid state switching device 216, during the initial step of the switching sequence, the higher on resistance of solid state switching device 212 does not impact the ultimate performance of compound switch 210. Moreover, because there is no DC current flowing through solid state switching device 212, there is negligible DC voltage drop across terminals 234A and 234B of solid state switching device 212. Because the terminals 234A and 234B of electromechanical switching device 214 are connected to the terminals 232A and 232B, it follows that there is negligible DC voltage across electromechanical switching device 214. Electromechanical switching device 214 may be closed in this state.

In some scenarios, there may be an AC component to the voltage applied across terminals $T_1$ and $T_2$. If there is an AC component, including a switching transient, across the terminals $T_1$ and $T_2$, this voltage may divide across the solid state switching devices 212 and 216 in proportion to their capacitances. Accordingly, though a negligible DC component of the voltage may appear across solid state switching device 212 during hot switching of compound switch 210, the AC component of that signal may be larger. If that AC component were to exceed Vsw for electromechanical switching device 214, hot switching of compound switch 210 may degrade the performance of electromechanical switching device 214. To avoid this scenario, solid state switching device 212 may be selected to have a capacitance relative to the capacitance of solid state switching device 216 to be such that, during the switching sequence, a capacitive voltage divider formed by the capacitance of solid state switching devices 212 and 216 yields a low enough voltage across the terminals 232A and 232B of solid state switching device 212 that is below Vsw of electromechanical switching device 214.

Representative relative values of parameters for solid state switching device 212 and solid state switching device 216 are given above, with the values of the parameters for solid state switching device 212 being given in conjunction with a solid state switching device with a low off capacitance. Values of parameters suitable for a device serving as a solid state switching device 216 are given in conjunction with a solid state switching device with a low on resistance. Though, it should be appreciated that other devices, with different values for these parameters, may similarly achieve the result of ensuring both a low DC and low AC component of a hot switched voltage across terminals 234A and 234B of an electromechanical relay when it is activated as part of a closing sequence for a compound switch.

In the example of FIG. 2A, the closing sequence completes with solid state switching device 216 closing following closing of electromechanical switching device 214. In this example, solid state switching device 216 has a low on resistance. Accordingly, the overall on resistance for compound switch 210 is the sum of the on resistances of electromechanical switching device 214 and solid state switching device 216.

Example 1 provides an illustration of values that may be achieved with a compound switch as in FIG. 2A.

Example 1

| | |
|---|---|
| Roff | 1.7E+11 |
| Coff | 10.2 |
| Ron | 0.27 |
| Ton + Toff | 6.65 |
| Idc | 1.0 |
| Vsw | 60.0 |
| Isw | 1.0 |
| FOM2 | 36 |
| FOM4 | 5.4E+11 |

A compound switch the architecture of FIG. 2A was observed to be robust, which the inventors theorize results from electromechanical relay K2 being "cold switched." This cold switching of the electromechanical switching device K2 occurs even when the compound switch 210 is hot switched with a voltage across terminals $T_1$ and $T_2$.

FIG. 2B illustrates an exemplary switching sequence for the compound switch of FIG. 2A. In this case, using the nomenclature as described above, U1 corresponds to solid state switching device 212. K2 corresponds to electromechanical switching device 214, and U3 corresponds to solid state switching device 216. As can be seen, when K2 closes, its terminals are isolated from the voltage across terminals T1 and T2 because U3 is open and because its terminals are shorted by the relatively low capacitance path provided by U1.

In the example of FIG. 2B, table 250 illustrates a sequence of operations of the switching devices forming compound switch 210 during closing of compound switch 210. In this example, the row designated "time" gives time values in milliseconds. Accordingly, the column headed by a time −0.1 indicates the state of the control inputs to solid state switching elements 212 and 216 and electromechanical switching device 214 preceding a time at which the compound switch is activated to turn on.

The column headed with a time of 0 indicates the time at which the switching sequence begins. As can be seen, at this time, control inputs for solid state switching device 212 (U1) are asserted, turning on solid state switching device 212.

The next column, headed with a time of 0.15, illustrates a time shortly after the application of control signals to solid state switching device 212. In this example, that time is 0.15 milliseconds. The specific time selected may be sufficiently long to allow the solid state switching device 212 to settle in the on state.

It should be appreciated that the specific values of the times at which the events in the switching cycle occur may depend on the characteristics of the individual switching devices or other factors. Accordingly, the specific time values illustrated in FIG. 2B are exemplary rather than limiting. Regardless of the specific time at which the next event in the switching sequence occurs, that event may be activating electromechanical switching device 214 to place it in a low resistance on state.

The next column is headed by a time indicating 0.65 milliseconds following initiation of the switching sequence. At that time, the control inputs to solid state switching device 216 are applied, also closing solid state switching device 216.

The final column in table 250 is indicated as the "ready" column. This column indicates a time at which compound switch 210 is ready for use, meaning that switching transients and other effects that may interfere with reliable operation of compound switch 210 have passed. In an automatic test system, this time, here illustrated as 5.65 millisecond, may represent the amount of time after application of a command to close compound switch 210 until signals propagating through compound switch 210 are used in testing a semiconductor device.

Table 260 illustrates a corresponding sequence of operations for turning off compound switch 210. As with Table 250, Table 260 illustrates that the switching devices making up compound switching device 210 are actuated in an order indicated by their numbering. Though, for turning off compound switch 210, the switching devices are actuated in reverse order. Accordingly, at time zero, indicating a time at which a command to open compound switch 210 is provided, solid state switching device 216 is turned off.

At a second time, here 0.5 milliseconds following that command, electromechanical switching device 214 is actuated. At yet a further time, here illustrated as one millisecond following the command, solid state switching device 212 is actuated. Subsequently, here illustrated to be at a time 1.1 milliseconds following application of the command, compound switch 210 has settled into an off state.

FIG. 2A illustrates a configuration of compound switch 210 that may be useful in scenarios in which a hot switched voltage across terminals $T_1$ and $T_2$ may have an AC component. FIG. 3A illustrates a compound switch 310 that may provide a simpler implementation for scenarios in which any AC voltage across terminals $T_3$ and $T_4$ during hot switching of compound switch 310 is unlikely to impact the reliability of electromechanical switching device 312.

In this example, compound switch 310 includes two switching devices, electromechanical switching device 312 and solid state switching device 314. In this example, electromechanical switching device 312 has properties as given above. Solid state switching device 314 has properties as given above for a solid state switching device with low Coff.

Example 2 provides an illustration of values that may be achieved with a compound switch as in FIG. 3A.

Example 2

| | |
|---|---|
| Roff | 1.0E+12 |
| Coff | 0.2 |
| Ron | 50 |
| Ton + Toff | 1.25 |
| Idc | 0.04 |
| Vsw | 200.0 |
| Isw | 0.04 |
| FOM2 | 10 |
| FOM4 | 6.4E+11 |

FIG. 3B provides an example of a switching sequence for compound switch 310. Table 350 illustrates timing and sequencing of operations to close compound switch 310. As illustrated in FIG. 350, electromechanical switching device 312 is closed (i.e., turned on) at a time when solid state switching device 314 is turned off. Accordingly, even when compound switch 310 is hot switched, electromechanical switching device 312 is "cold switched" because it is isolated from the voltage across terminals $T_3$ and $T_4$ by solid state switching device 314. As shown in Table 360, this condition is repeated for the sequence of events to open compound switch 310.

Figure 4A:
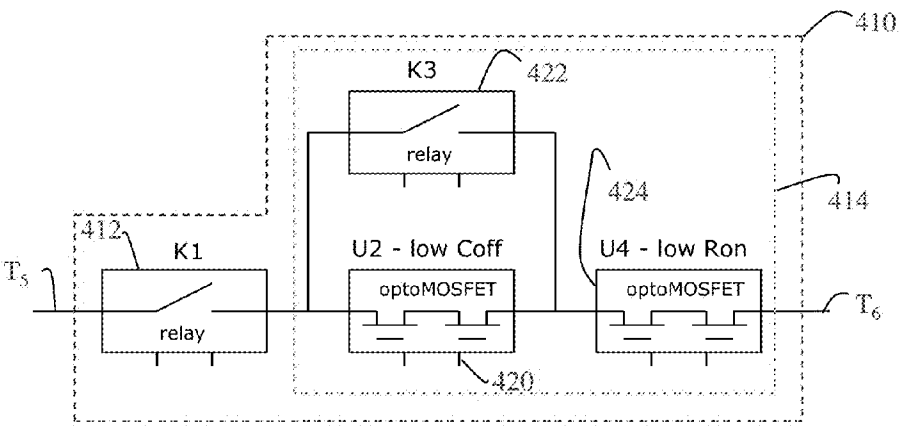
FIG. 4A is a schematic illustration of a third exemplary embodiment of a compound switch.

Turning to FIG. 4A, a further example of a compound switch 410 is provided. In this example, compound switch 410 has an architecture similar to compound switch 310. However, rather than a single element forming solid state switching device 314, compound switch 410 includes a solid state switching device 414 that includes a combination of switching devices.

In this example, solid state switching device 414 has an architecture in the form of compound switching device 210. Like for compound switching device 210, FIG. 4A shows solid state switching device 414 assembled from solid state switching devices 420 and 424 and electromechanical switching device 422.

A compound switch with the architecture illustrated in FIG. 4A, may be applied even in scenarios when a hot switched voltage across terminals $T_5$ and $T_6$ has an AC component that might otherwise degrade the reliability of electromechanical switching device 412.

In this example, each of the electromechanical switching devices 412 and 422 has similar characteristics and may have parameters as described above for an electromechanical switching device. Though, it should be recognized it is not a requirement that both electromechanical switching device 412 and electromechanical switching device 422 have the same construction. In this example, solid state switching device 420 has values for parameters as defined above for a solid state switching device with low C off. Solid state switching device 424 has values of parameters as described above for a solid state switching device with a low R on. These values lead to a ratio of capacitance between solid state switching device 420 and solid state switching device 424 that ensures a low voltage across the terminals of electromechanical switching device 422 when it is actuated. Though, it should be appreciated that any suitable values for these parameters may be employed.

Example 3 provides an illustration of values that may be achieved with a compound switch as in FIG. 4A.

Example 3

| | |
|---|---|
| Roff | 1.0E+12 |
| Coff | 0.2 |
| Ron | 0.42 |
| Ton + Toff | 7.75 |
| Idc | 1.0 |
| Vsw | 60.0 |
| Isw | 1.0 |
| FOM2 | 1191 |
| FOM4 | 9.2E+13 |

Figure 4B:
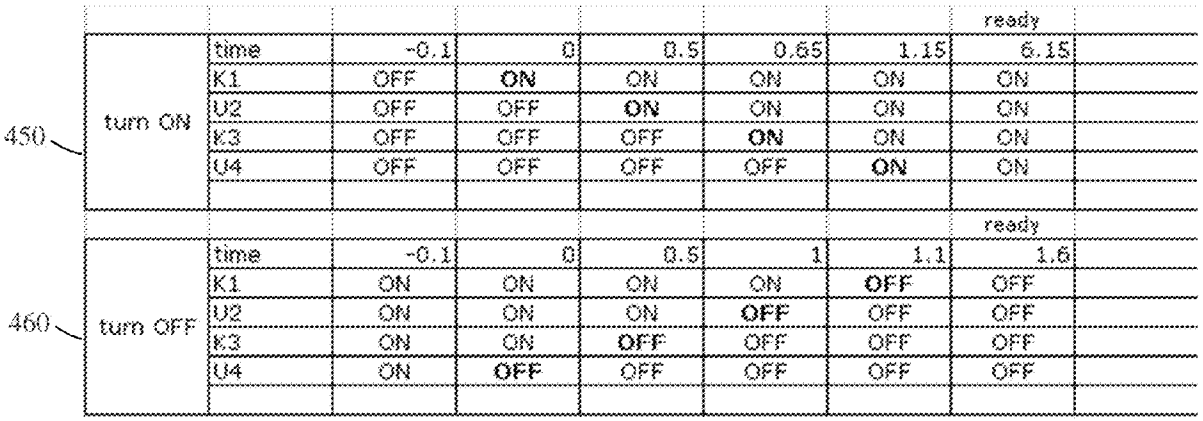
FIG. 4B is a table illustrating a sequence of operations in actuation of the compound switch of FIG. 4A.

FIG. 4B illustrates timing sequences for operation of the constituent switching devices illustrated in FIG. 4A. Table 450 illustrates a sequence of events during actuation of compound switch 410. In this example, Table 450 defines events during a closing sequence for compound switch 410. Table 460 defines corresponding events for an opening sequence for compound switch 410. Tables 450 and 460 are interpreted as described above in connection with FIGS. 2B and 3B—though the switching devices listed in the tables represent those depicted in FIG. 4A.

Figure 5A:
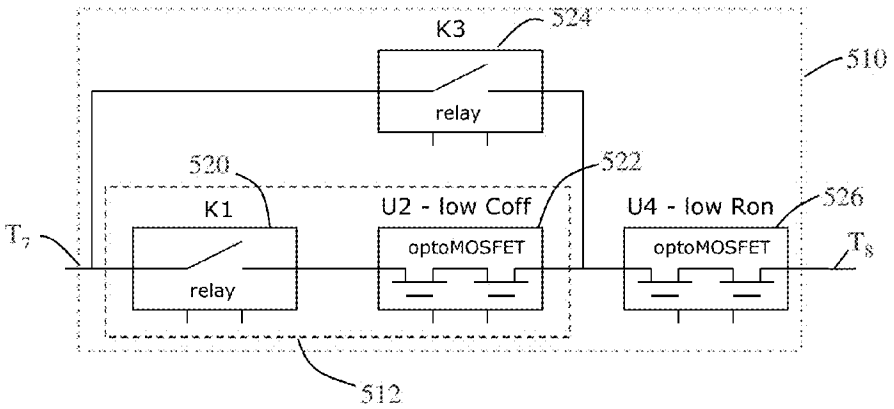
FIG. 5A is a schematic illustration of a fourth exemplary embodiment of a compound switch.

FIG. 5A illustrates a further alternative embodiment of a compound switch architecture. In this example, compound switch 510 has an architecture analogous to the architecture of compound switch 210 (FIG. 2A). However, in this example, solid state switching device 212 is implemented by a combo switch having an architecture like combo switch 310 (FIG. 3A). This architecture allows both electromechanical switching device 520 and electromechanical switching device 524 to be actuated even while a voltage is imposed across terminals $T_7$ and $T_8$ of compound switch 510. In this example, electromechanical switching devices 520 and 524 may have the characteristics as described above. Solid state switching device 522 may have characteristics as described above for a solid state switching device having a low Coff. Solid state switching device 526 may have characteristics as described above for a solid state switching device having a low Ron.

Example 4 provides an illustration of values that may be achieved with a compound switch as in FIG. 5A.

Example 4

| | |
|---|---|
| Roff | 5.0E+11 |
| Coff | 0.4 |
| Ron | 0.27 |
| Ton + Toff | 7.75 |
| Idc | 1.0 |
| Vsw | 60.0 |
| Isw | 1.0 |
| FOM2 | 926 |
| FOM4 | 3.6E+13 |

Figure 5B:
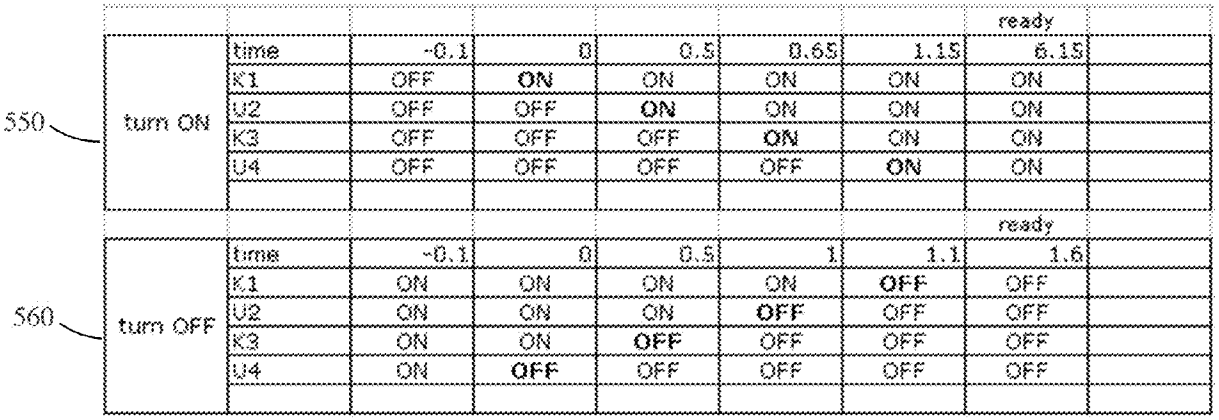
FIG. 5B is a table illustrating a sequence of operations in actuation of the compound switch of FIG. 5A.

FIG. 5B illustrates switching sequences for the switching devices making of compound switch 510. As with the other timing tables in FIGS. 6B . . . 12B, these timing tables are interpreted as described above—though the elements listed in the tables relate in each case to a different architecture. In this case, the table relates to the architecture in FIG. 5A.

As can be seen from Table 550, electromechanical switching device 520, when it is actuated, is isolated from a voltage across terminals $T_7$ and $T_8$ by solid state switching devices 522 and 526. Upon actuation, electromechanical switching device 524 is isolated from any DC component across terminals $T_7$ and $T_8$ by solid state switching device 526. Any AC component to a voltage across terminals $T_7$ and $T_8$ is relatively low across the terminals of solid state switching device 522 because of the relative capacitance of combo switch 512 and solid state switching device 526. Table 560 illustrates corresponding conditions created upon opening of combo switch 510.

Figure 6A:
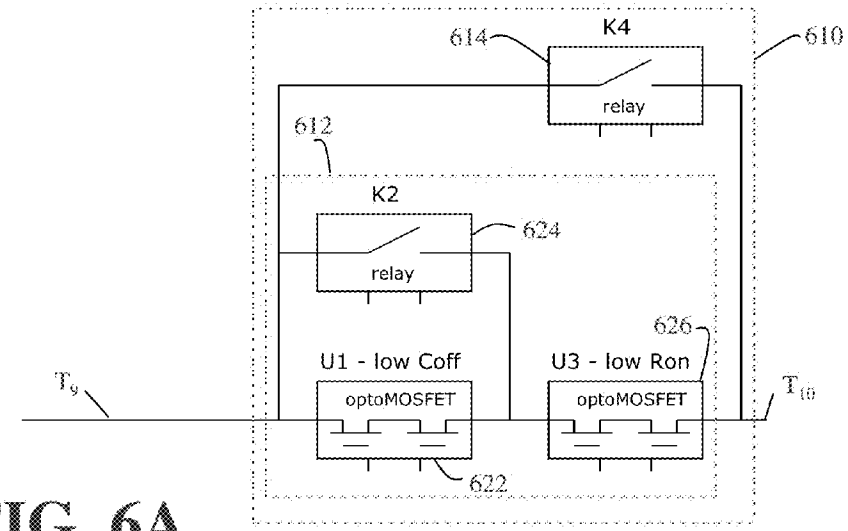
FIG. 6A is a schematic illustration of a fifth exemplary embodiment of a compound switch.
Figure 6B:
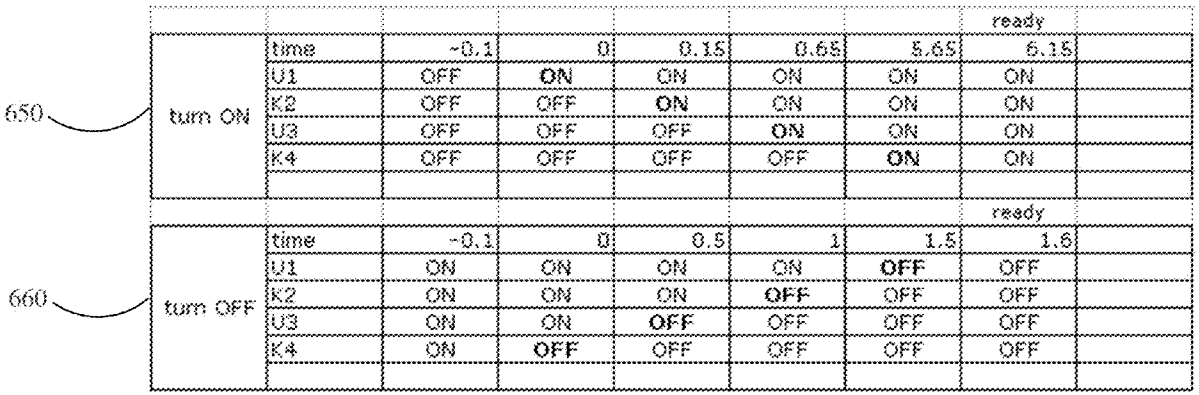
FIG. 6B is a table illustrating a sequence of operations in actuation of the compound switch of FIG. 6A.

FIG. 6A illustrates a further architecture of a compound switch. In this example, compound switch 610 includes an electromechanical switching device 614 connected between terminals $T_9$ and $T_{10}$. Electromechanical switching device 614 is connected in parallel with a solid state switching device implemented as compound switch 612. In this way, electromechanical switching device may shunt compound switching device 614.

Compound switch 612, in this example, has the same architecture as compound switch 210 (FIG. 2A). In this example, solid state switching devices 622 and 626 may have the same characteristics as solid state switching devices 212 and 216 (FIG. 2A), respectively. Electromechanical switching device 624 may have the same characteristics as electromechanical switching device 214 (FIG. 2A).

As shown in Table 650 (FIG. 6B), combo switch 610 is closed according to a sequence in which combo switch 612 is first effectively closed. Actuation of solid state switching device 624 as part of closing combo switch 612 may occur at a time when electromechanical switching device 624 is protected from a damaging hot switched voltage across terminals $T_9$ and $T_{10}$ by the combined operation of solid state switching devices 622 and 626. Table 660 illustrates a switching sequence for opening of compound switch 610 under which electromechanical switching device 624 is also protected from actuation with a damaging hot switched voltage across its terminals by operation of electromechanical switching devices 622 and 626.

Table 650 (FIG. 6B) also illustrates that as part of the closing sequence of compound switch 610, compound switch 612 is first closed. In this state, compound switch 612 has characteristics that ensure a relatively low voltage across the terminals of electromechanical switching device 614. Though, it should be appreciated that the specific voltage across the terminals may depend on the parameters of the components of compound switch 612 relative to parameters of other components in the circuit in which compound switch 610 is used. Nonetheless, in some scenarios, the operation of compound switch 612 will provide a voltage across the terminals of electromechanical switching device 614 that is below Vsw for electromechanical switching device 614 and therefore deemed safe for actuation of electromechanical switching device 614 without an unacceptable risk of degrading the reliability of electromechanical switching device 614. Table 660 similarly illustrates that upon opening of compound switch 610, electromechanical switching device 614 is actuated while compound switching device 612 is effectively in a closed state. In this way, electromechanical switching device 614 opens with a relatively low voltage across its terminals.

Example 5 provides an illustration of values that may be achieved with a compound switch as in FIG. 6A.

Example 5

| | |
|---|---|
| Roff | 1.4E+11 |
| Coff | 10.4 |
| Ron | 0.15 |
| Ton + Toff | 7.75 |
| Idc | 1.0 |
| Vsw | 60.0 |
| Isw | 0.37 |
| FOM2 | 64 |
| FOM4 | 2.6E+11 |

Figures 7A, 7B:
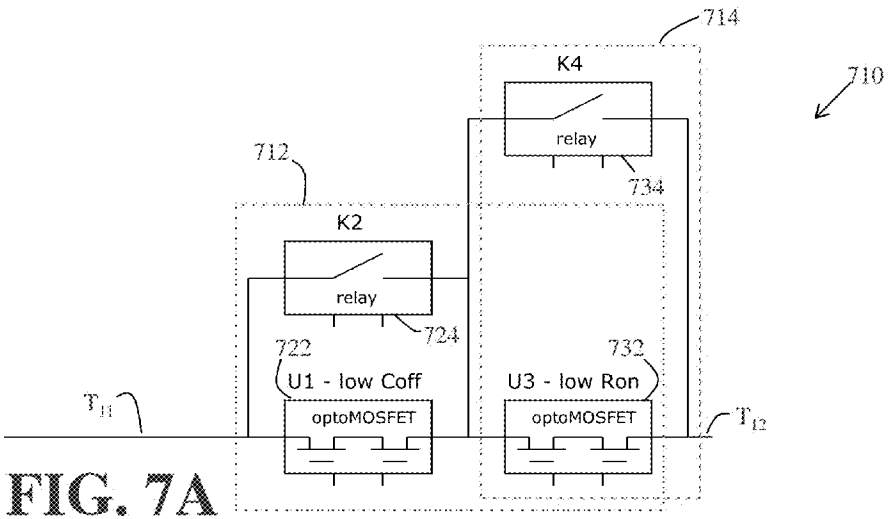
FIG. 7A is a schematic illustration of a sixth exemplary embodiment of a compound switch.
FIG. 7B is a table illustrating a sequence of operations in actuation of the compound switch of FIG. 7A.

FIG. 7A shows yet a further example of an architecture of a compound switch. In FIG. 7A, compound switch 710 is shown in with terminals $T_{11}$ and $T_{12}$. In this example, compound switch 710 includes a compound switch 712, which has an architecture similar to that of compound switch 210 (FIG. 2A). In this example, solid state switching devices 722 and 732 may have characteristics similar to solid state switching devices 212 and 216 (FIG. 2A). Electromechanical switching device 624 may have characteristics similar to those of electromechanical switching device 214 (FIG. 2A).

As illustrated in Table 750 (FIG. 7B), solid state switching device 722, electromechanical switching device 724 and solid state switching device 732 may be actuated in the same order as corresponding switching devices of FIG. 2A upon closing of compound switch 710. Table 760 illustrates that those switching devices may be opened in an order corresponding to the order that matches the order of opening corresponding switching devices upon opening of compound switch 210.

Table 750 illustrates that, subsequent to closing of compound switch 712, electromechanical switching device 734 may close. In this example, electromechanical switching device 734 is connected in parallel with solid state switching device 732. Accordingly, closing electromechanical switching device 734 further lowers the on resistance of compound switch 710. Thus, an alternative approach for describing the architecture of compound switch 710 is that it has the same architecture as compound switch 210 (FIG. 2A) but with solid state switching device 216 replaced by comboswitch 714.

Example 6 provides an illustration of values that may be achieved with a compound switch as in FIG. 7A.

Example 6

| | |
|---|---|
| Roff | 1.7E+11 |
| Coff | 10.2 |
| Ron | 0.3 |
| Ton + Toff | 7.75 |
| Idc | 1.0 |
| Vsw | 60.0 |
| Isw | 0.833 |
| FOM2 | 33 |
| FOM4 | 3.5E+11 |

Figures 8A, 8B:
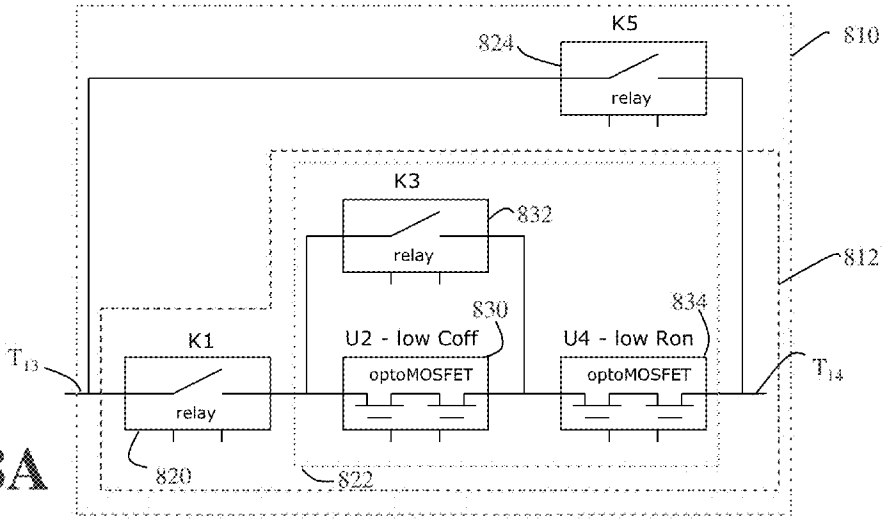
FIG. 8A is a schematic illustration of a seventh exemplary embodiment of a compound switch.
FIG. 8B is a table illustrating a sequence of operations in actuation of the compound switch of FIG. 8A.

FIG. 8A illustrates yet a further alternative architecture for a compound switch. FIG. 8A illustrates a compound switch 810 that may be hot switched with a voltage across terminals $T_{13}$ and $T_{14}$. In this example, compound switch 810 is formed from an electromechanical switching device 824 connected in parallel with a solid state switching device. For closing compound switch 810, the solid state switching device may first be closed, providing a low impedance path between the terminals $T_{13}$ and $T_{14}$. A low impedance path provides a low voltage drop across terminals, protecting the electromechanical switching device 824 from switching with a voltage across its terminals large enough to degrade reliability of electromechanical switching device 824.

In this example, the solid state switching device in parallel with electromechanical switching device 824 is implemented as compound switch 812. Compound switch 812 includes an electromechanical switching device 820 in series with a solid state switching device. In this example, that solid state switching device is also implemented as a compound switch 822. Here, compound switch 822 is shown with the same architecture as compound switch 210 (FIG. 2A). Accordingly, solid state switching devices 830 and 834 may have characteristics similar to those of solid state switching devices 212 and 216 (FIG. 2), respectively. Electromechanical switching device 832 may have characteristics similar to those of electromechanical switching device 214 (FIG. 2A).

FIG. 8B illustrates in Table 850 a switching sequence for the elements of compound switch 810. As illustrated in Table 850, solid state switching device is isolated from a hot switched voltage across terminals $T_{13}$ and $T_{14}$ by compound switch 822. Electromechanical switching device 832, when actuated, is protected from a hot switched voltage by the combined operation of solid state switching devices 830 and 834. Table 860 illustrates that the electromechanical switching devices are similarly protected during an opening sequence of compound switch 810.

Example 7 provides an illustration of values that may be achieved with a compound switch as in FIG. 8A.

Example 7

| | |
|---|---|
| Roff | 5.0E+11 |
| Coff | 0.4 |
| Ron | 0.15 |
| Ton + Toff | 8.75 |
| Idc | 1.0 |
| Vsw | 60.0 |
| Isw | 0.2 |
| FOM2 | 1667 |
| FOM4 | 1.4E+13 |

Figures 9A, 9B:
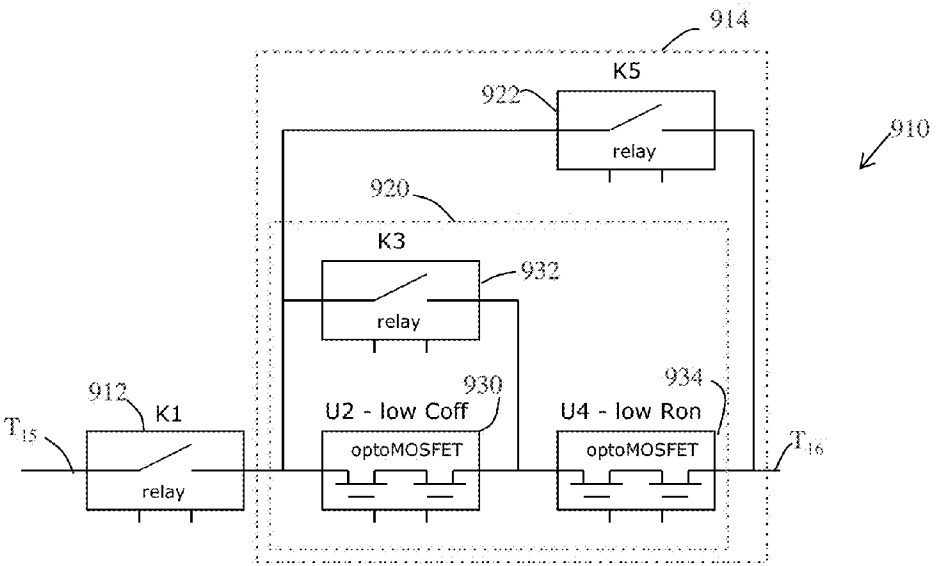
FIG. 9A is a schematic illustration of an eighth exemplary embodiment of a compound switch.
FIG. 9B is a table illustrating a sequence of operations in actuation of the compound switch of FIG. 9A.

Yet a further architecture for a compound switch is illustrated in FIG. 9A. FIG. 9A illustrates a compound switch 910. In this example, compound switch 910 has an architecture between terminals $T_{15}$ and $T_{16}$ in the form of compound switch 310 (FIG. 3A). As shown in FIG. 9A an electromechanical switching device 912 is in series with a solid state switching device. In this example, the solid state switching device is implemented as a compound switch 914. Accordingly, electromechanical switching device 912 may have characteristics similar to those described above for electromechanical switching device 312 (FIG. 3A).

In this example, compound switch 914 has the same architecture as compound switch 610 (FIG. 6A). Accordingly, electromechanical switching device 922 may have characteristics similar to electromechanical switching device 614 (FIG. 6A). Similarly, compound switch 920, forming a portion of compound switch 914, may have characteristics similar to those of compound switch 612 (FIG. 6A). Accordingly, electromechanical switching device 932 may have characteristics similar to those of electromechanical switching device 624. Solid state switching devices 930 and 934 may have characteristics similar to those of solid state switching devices 622 and 626 (FIG. 6A), respectively.

Table 950 (FIG. 9B) illustrates the switching sequence upon closing of compound switch 910. As shown, the switching sequence resembles that of compound switch 610 (FIG. 6B) preceded by operation of an electromechanical switching device, as illustrated in FIG. 3B. Table 960 illustrates a sequence upon opening of compound switch 910. As illustrated in Table 960, the switching sequence is similar to that of compound switch 610 (FIG. 6B) followed by opening of an electromechanical switching device as illustrated in FIG. 3B.

Example 8 provides an illustration of values that may be achieved with a compound switch as in FIG. 9A.

Example 8

| | |
|---|---|
| Roff | 1.0E+12 |
| Coff | 0.2 |
| Ron | 0.246 |
| Ton + Toff | 8.75 |
| Idc | 1.0 |
| Vsw | 60.0 |
| Isw | 0.37 |
| FOM2 | 2029 |
| FOM4 | 4.2E+13 |

Figures 10A, 10B:
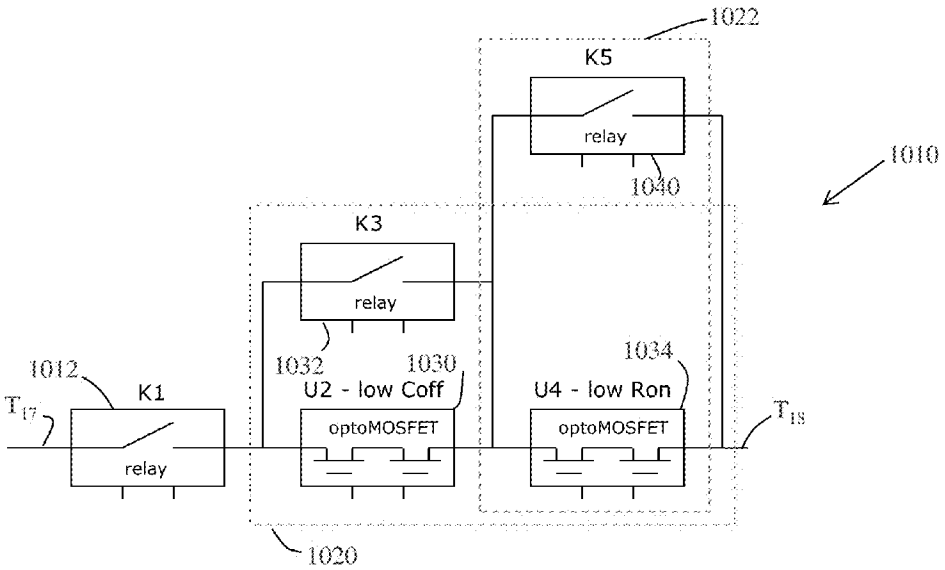
FIG. 10A is a schematic illustration of an ninth exemplary embodiment of a compound switch.
FIG. 10B is a table illustrating a sequence of operations in actuation of the compound switch of FIG. 10A.

FIG. 10A illustrates yet a further alternative embodiment of a compound switching device. In this example, compound switching device 1010 is shown with an architecture between terminals $T_{17}$ and $T_{18}$ similar to that of compound switch 310 (FIG. 3A). Though, in this case, the solid state switching device analogous to solid state switching device 314 is itself implemented as a compound switching device.

Accordingly, FIG. 10A shows an electromechanical switching device 1012, which may have characteristics similar to those of electromechanical device 312 (FIG. 3A). Electromechanical switching device 1012 is shown in series with a solid state switching device. Here, that solid state switching device is a compound switch, having an architecture similar to the architecture of compound switch 710 (FIG. 7A). Accordingly, solid state switching devices 1030 and 1034 may have characteristics similar to those of solid state switching devices 722 and 732 (FIG. 7A), respectively. Similarly, electromechanical switching devices 1032 and 1040 may have characteristics similar to those of electromechanical switching devices 724 and 734 (FIG. 7A), respectively.

As illustrated in Table 1050 (FIG. 10B), compound switch 1010 may be operated in accordance with a switching sequence similar to that illustrated for compound switch 610, but proceeded by closing of electromechanical switch 1012 as described above in connection with FIG. 3B. Table 1060 (FIG. 10B) illustrates that upon opening of compound switch 1010, a switching sequence as illustrated in Table 660 (FIG. 6B) may be used followed by opening of an electromechanical switching device 1012, as illustrated in Table 360 (FIG. 3B).

Example 9 provides an illustration of values that may be achieved with a compound switch as in FIG. 10A.

Example 9

| | |
|---|---|
| Roff | 1.0E+12 |
| Coff | 0.2 |
| Ron | 0.367 |

-continued

| | |
|---|---|
| Ton + Toff | 8.75 |
| Idc | 1.0 |
| Vsw | 60.0 |
| Isw | 0.833 |
| FOM2 | 1364 |
| FOM4 | 7.8E+13 |

Figure 11A:
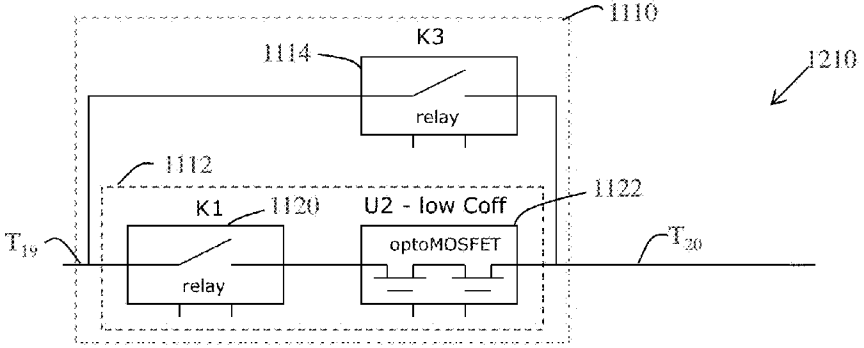
FIG. 11A is a schematic illustration of a tenth exemplary embodiment of a compound switch.

FIG. 11A illustrates yet a further alternative embodiment of a compound switch. In this example, compound switch 1110 is configured for hot switching between terminals $T_{19}$ and $T_{20}$.

Compound switch 1110 is implemented as a parallel combination of an electromechanical switching device 1014 and a solid state switching device. In this example, the solid state switching device is implemented as compound switch 1112. In operation, compound switch 1112 provides a low impedance path across the terminals of electromechanical switching device 1114 so as to provide a low voltage drop between the terminals $T_{19}$ and $T_{20}$ upon switching of electromechanical switching device 1114.

In this example, compound switch 1112 has an architecture similar to that of compound switch 310 (FIG. 3A). According, electromechanical switching device 1120 may have characteristics similar to that of electromechanical switching device 312 (FIG. 3A). Solid state switching device 1122 may have characteristics similar to that of solid state switching device 314 (FIG. 3A).

Figure 11B:
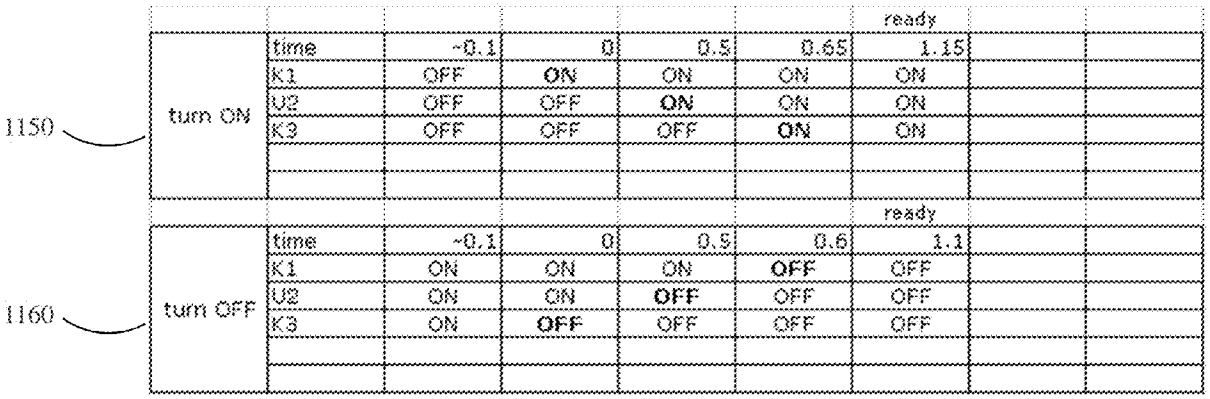
FIG. 11B is a table illustrating a sequence of operations in actuation of the compound switch of FIG. 11A.

FIG. 11B illustrates a switching sequence for closing of compound switch 1110. As can be seen in table 1150, the switching sequence upon closing includes actions that first close compound switch 1112 and then close electromechanical switching device 1114. Table 1160 shows the sequence upon opening of compound switch 1110. As illustrated, electromechanical switching device 1114 first opens. Then, compound switching device 1112 is opened.

Example 10 provides an illustration of values that may be achieved with a compound switch as in FIG. 11A.

Example 10

| | |
|---|---|
| Roff | 5.0E+11 |
| Coff | 0.4 |
| Ron | 0.15 |
| Ton + Toff | 2.25 |
| Idc | 1.0 |
| Vsw | 200.0 |
| Isw | 0.002 |
| FOM2 | 1667 |
| FOM4 | 1.5E+12 |

Figure 12A:
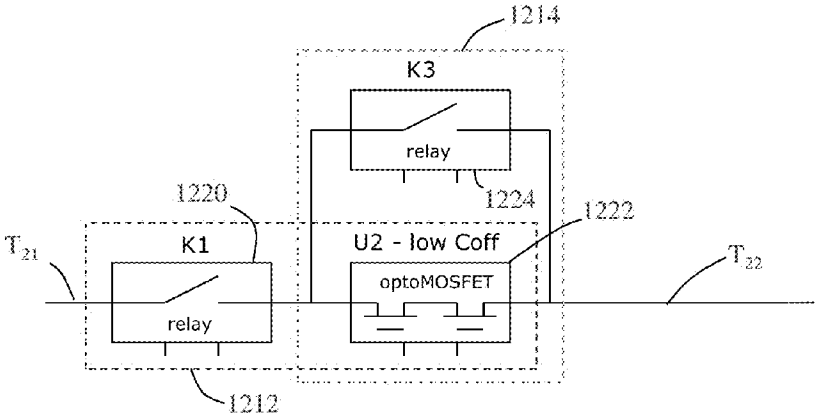
FIG. 12A is a schematic illustration of an eleventh exemplary embodiment of a compound switch.

FIG. 12A illustrates yet a further alternative embodiment of a compound switch. FIG. 12A shows a compound switch 1210 with terminals $T_{21}$ and $T_{22}$. In this example, compound switch 1210 has an architecture similar to that of compound switch 310 (FIG. 3A). Accordingly, electromechanical switching device 1220 is shown in series with a solid state switching device. Accordingly, electromechanical switching device 1220 may have characteristics similar to those of electromechanical switching device 312 (FIG. 3A).

In this example, the solid state switching device in series with electromechanical switching device 1220 is implemented as compound switch 1214. In this example, compound switch 1214 is implemented by a parallel combination of an electromechanical switching device 1224 and an solid state switching device 1222. Solid state switching device 1222 may have characteristics similar to those of solid state switching device 314 (FIG. 3A). Though by forming a combination switch including electromechanical switching device 1224 in parallel with solid state switching device 1222, upon closing of compound switch 1214 the on resistance may be lower than four solid state switching device 314 alone.

Figure 12B:
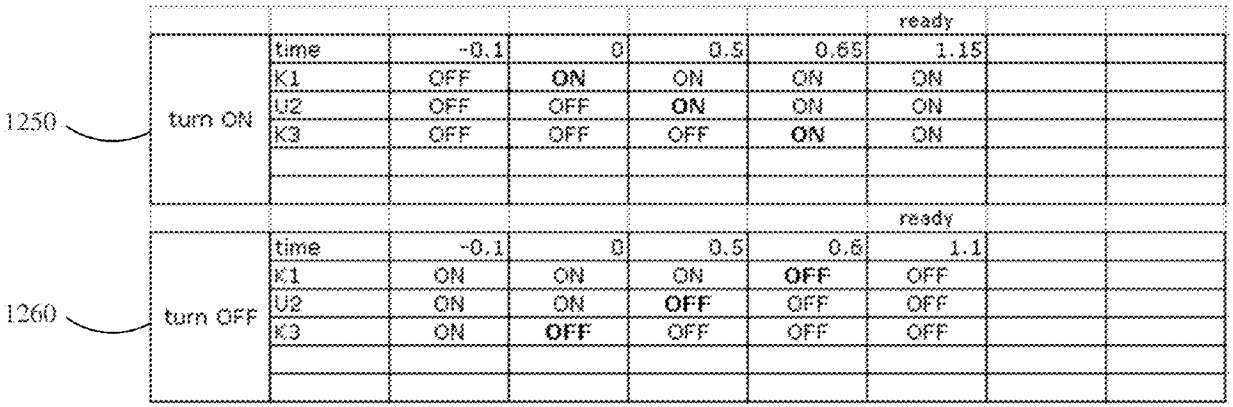
FIG. 12B is a table illustrating a sequence of operations in actuation of the compound switch of FIG. 12A.

FIG. 12B illustrates in Table 1250 a switching sequence for compound switch 1210. As can be seen in Table 1250, upon closing of compound switch 1210, electromechanical switching device 1220 is closed at a time when it is isolated from a hot switched voltage across terminals $T_{21}$ and $T_{22}$ by compound switch 1214 being in an open state. Electromechanical switching device 1224 is protected upon closing by a low impedance path across its terminal, created by solid state switching device 1222 already being turned on when electromechanical switching device 1224 is actuated. Table 1260 (FIG. 12B) illustrates that electromechanical switching devices 1220 and 1224 are similarly protected from a hot switched voltage during an opening sequence.

In the foregoing example embodiments, compound switches are illustrated formed with a combination of electromechanical switching devices and solid state switching devices. In each of the examples, the constituent switching devices are illustrated as having the same characteristics. These implementations were selected for simplicity in comparing performance characteristics of the compound switches. It should be appreciated however, that these specific performance characteristics are not critical to the invention. Compound switches may be formed with constituent switching devices of different characteristics for different combinations of characteristics.

Example 11 provides an illustration of values that may be achieved with a compound switch as in FIG. 12A.

Example 11

| | |
|---|---|
| Roff | 1.0E+12 |
| Coff | 0.2 |
| Ron | 0.3 |
| Ton + Toff | 2.25 |
| Idc | 1.0 |
| Vsw | 200.0 |
| Isw | 0.002 |
| FOM2 | 1667 |
| FOM4 | 3.0E+12 |

It should be appreciated that compound switches, including when incorporated in an switch matrix instrument as described above, may be used in a method of testing a semiconductor device. Such testing may include setting the state of compound switches to connect instruments in a test system to generate or measure signals at specific points on a device under test. The method may further include reconfiguring the switches, including by hot-switching while the instruments are still generating test signals, to connect those instruments to other test points. The test of the semiconductor device may then continue.

Having thus described several aspects of at least one embodiment of this invention, it is to be appreciated that various alterations, modifications, and improvements will readily occur to those skilled in the art.

For example, it should be appreciated that, though the invention is illustrated in connection with automatic test equipment used in the manufacture of semiconductor devices, the invention is not so limited. A compound switch may be used in any suitable type of test equipment. Moreover, a compound switch as described herein may be used in other types of systems and may even be packaged as a separate component, which, in some embodiments, may include a control circuit to operate the switching devices constituting the compound switch in accordance with a defined sequence.

Further, numeric values of various parameters are provided as examples. It should be appreciated that variations around the stated values may be made.

Moreover, the specific values given are illustrative of a specific embodiment. In other embodiments, the ratios of values may be maintained, but other values may be used instead.

In other embodiments, the values of some parameters may depend on the values of other parameters. For example, also in the embodiment of FIG. 2A, solid state switching device 216 may be selected to have a capacitance that depends on the current sourcing capabilities of electromechanical switching device 214. That capacitance may be such that electromechanical switching device 214 can switch into that capacitance at a target operating voltage and/or within a target time.

Such alterations, modifications, and improvements are intended to be part of this disclosure, and are intended to be within the spirit and scope of the invention. Further, though advantages of the present invention are indicated, it should be appreciated that not every embodiment of the invention will include every described advantage. Some embodiments may not implement any features described as advantageous herein and in some instances. Accordingly, the foregoing description and drawings are by way of example only.

The above-described embodiments of the present invention can be implemented in any of numerous ways. For example, the embodiments may be implemented using hardware, software or a combination thereof. As a specific example, timing circuit 160 may be implemented with software programming of a general purpose computer or by firmware programming in an FPGA or other programmable device. Alternatively, operations to generate control signals may be implemented by the configuration of an ASIC or other hardware component. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the invention may be embodied as a computer readable storage medium (or multiple computer readable media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other tangible computer storage medium) encoded with one or more programs that, when executed on one or more computers or other processors, perform methods that implement the various embodiments of the invention discussed above. As is apparent from the foregoing examples, a computer readable storage medium may retain information for a sufficient time to provide computer-executable instructions in a non-transitory form. Such a computer readable storage medium or media can be transportable, such that the program or programs stored thereon can be loaded onto one or more different computers or other processors to implement various aspects of the present invention as discussed above. As used herein, the term "computer-readable storage medium" encompasses only a computer-readable medium that can be considered to be a manufacture (i.e., article of manufacture) or a machine. Alternatively or additionally, the invention may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A compound switch having a first terminal and a second terminal and an internal terminal, the compound switch comprising:

an electromechanical switching device having a first terminal and second terminal;

a first solid state switching device having a first terminal and a second terminal; and a second solid state switching device having a first terminal and a second terminal, a control circuit for generating control signals in accordance with a closing sequence of at least the electromechanical switching device, the first solid state switching device and the second solid state switching device, to close a connection between the first terminal and the second terminal of the compound switch, wherein, during the closing sequence, a control signal is applied to the first solid state switching device prior to a control signal being applied to the electromechanical switching device;

wherein:

the electromechanical switching device and the first solid state switching device are connected in parallel between the first terminal of the compound switch and the internal terminal of the compound switch and the second solid state switching device is connected between the internal terminal of the compound switch and the second terminal of the compound switch.

2. The compound switch of claim 1, wherein:

the first solid state switching device comprises a first control input;

the electromechanical switching device comprises a second control input;

the second solid state switching device comprises a third control input;

wherein the closing sequence comprises:

generating a control signal at the first control input that places the first solid state switching device in a low resistance state;

subsequently generating a control signal at the second input that places the electromechanical switching device in a low resistance state; and subsequently generating a control signal at the third control input that places the second solid state switching device in a low resistance state.

3. The compound switch of claim 2, wherein:

the control circuit is further adapted for controlling an opening sequence, the opening sequence comprising:

generating a control signal at the third control input that places the second solid state switching device in a high resistance state;

subsequently generating a control signal at the second input that places the electromechanical switching device in a high resistance state; and subsequently generating a control signal at the first control input that places the first solid state switching device in a high resistance state.

4. The compound switch of claim 1, wherein:

the electromechanical switching device is a reed relay.

5. The compound switch of claim 1, wherein:

the first solid state switching device and the second solid state switching device have different on resistance and different off capacitance.

6. The compound switch of claim 1, wherein:

the first solid state switching device has a lower on capacitance than the second solid state switching device.

7. The compound switching device of claim 6, wherein:

the second solid state switching device has a lower on resistance than the first solid state switching device.

8. The compound switching device of claim 7, wherein:

the on resistance of the second solid state switching device is no more than four times the on resistance of the electromechanical switching device.

9. The compound switching device of claim 1, wherein:

the compound switching device of claim 1 comprises a first switching device; and the compound switching device further comprises a second electromechanical switching device coupled to shunt the compound switching device of claim 1.

10. The compound switching device of claim 1, wherein:

the compound switching device of claim 1 comprises a first switching device; and the compound switching device further comprises a second electromechanical switching device coupled to shunt the second solid-state switching device of the compound switch of claim 1.

11. A compound switch having a first terminal and a second terminal, the compound switch comprising:

an electromechanical switching device having a first terminal and second terminal; and a solid state switching device having a first terminal and a second terminal, a control circuit for generating control signals in accordance with a closing sequence of at least the electromechanical switching device and the solid state switching device to close a connection between the first terminal and the second terminal of the compound switch, wherein, during the closing sequence, a control signal is applied to the solid state switching device prior to a control signal being applied to the electromechanical switching device;

wherein:

the electromechanical switching device and the solid state switching device are connected in series between the first terminal of the compound switch and the second terminal of the compound switch with the second terminal of the electromechanical switching device coupled to the first terminal of the solid state switching device.

12. The compound switch of claim 11, wherein:

the electromechanical switching device is a reed relay.

13. The compound switch of claim 11, wherein:
the solid state switching device comprises an optoelectronic relay.

14. The compound switch of claim 11, wherein:
the electromechanical switching device comprises a first control input;
the solid state switching device comprises a second control input; and
the first control input and the second control input are configured for separate control of the electromechanical switching device and the solid state switching device.

15. The compound switch of claim 14, wherein:
the closing sequence comprises:
generating a control signal at the first control input that places the electromechanical switching device in a low resistance state; and
subsequently generating a control signal at the second control input that places the solid state switching device in a low resistance state.

16. The compound switch of claim 15, wherein:
the control circuit is further adapted for controlling an opening sequence, the opening sequence comprising:
generating a control signal at the second control input that places the solid state switching device in a high resistance state; and
subsequently generating a control signal at the first control input that places the electromechanical switching device in a high resistance state.

17. The compound switch of claim 11, wherein:
the electromechanical switching device of claim 11 comprises a first electromechanical switching device;
the solid state switching device of claim 11 is a first solid state switching device; and
the compound switch of claim 11 further comprises:
a second electromechanical switching device connected in parallel with the first solid state switching device;
a second solid state switching device connected in series with the parallel combination of the second electromechanical switching device and the first solid state switching device.

18. The compound switch of claim 11, wherein:
the electromechanical switching device of claim 11 comprises a first electromechanical switching device;
the solid state switching device of claim 11 comprises a first solid state switching device; and
the compound switch of claim 11 further comprises:
a second electromechanical switching device connected in parallel with the first solid state switching device;
a second solid state switching device connected in series with the parallel combination of the second electromechanical switching device and the first solid state switching device; and
a third electromechanical switching device coupled to shunt the first and second electromechanical switching devices and the second solid state switching device when the third electromechanical switching device is in a low resistance state.

19. The compound switch of claim 11, wherein:
the electromechanical switching device of claim 11 comprises a first electromechanical switching device;
the solid state switching device of claim 11 comprises a first solid state switching device; and
the compound switch of claim 11 further comprises:
a second electromechanical switching device connected in parallel with the first solid state switching device;
a second solid state switching device connected in series with the parallel combination of the second electromechanical switching device and the first solid state switching device; and
a third electromechanical switching device coupled to shunt the second electromechanical switching devices and the second solid state switching device when the third electromechanical switching device is in a low resistance state.

20. The compound switch of claim 11, wherein:
the electromechanical switching device of claim 11 comprises a first electromechanical switching device;
the solid state switching device of claim 11 comprises a first solid state switching device; and
the compound switch of claim 11 further comprises:
a second electromechanical switching device connected in parallel with the first solid state switching device;
a second solid state switching device connected in series with the parallel combination of the second electromechanical switching device and the first solid state switching device; and
a third electromechanical switching device connected in parallel with the second solid state switching device.

21. The compound switch of claim 11, wherein:
the compound switching device further comprises a second electromechanical switching device, the second electromechanical switching device being coupled to shunt the solid state switching device and first electromechanical switching device when the second electromechanical switching device is in a low resistance state.

22. The compound switch of claim 11, wherein:
the compound switch of claim 11 comprises a first switching device; and
the compound switch further comprises a second electromechanical switching device, the second electromechanical switching device being connected in parallel to the solid state switching device.

23. A compound switch having a first terminal and a second terminal, the compound switch comprising:
a first electromechanical switching device having a first terminal and second terminal; and
a first solid state switching device having a first terminal and a second terminal, wherein the second terminal of the first electromechanical switching device is connected to the first terminal of the first solid state switching device;
a second electromechanical switching device connected in parallel with the first solid state switching device; and
a second solid state switching device having a first terminal and second terminal, wherein the first terminal of the second solid state switching device is connected to the second terminal of the first solid state switching device; and
a third electromechanical switching device connected to shunt, when closed, at least the second solid state switching device.

* * * * *